US005320765A

United States Patent [19]

Fetterman, Jr. et al.

[11] Patent Number: 5,320,765

[45] Date of Patent: * Jun. 14, 1994

[54] LOW ASH LUBRICANT COMPOSITIONS FOR INTERNAL COMBUSTION ENGINES

[75] Inventors: Glen P. Fetterman, Jr., Morris Plains; Alan A. Schetelich, Scotch Plains, both of N.J.

[73] Assignee: Exxon Chemical Patents Inc., Linden, N.J.

[ * ] Notice: The portion of the term of this patent subsequent to Apr. 7, 2009 has been disclaimed.

[21] Appl. No.: 44,930

[22] Filed: Apr. 8, 1993

Related U.S. Application Data

[60] Continuation of Ser. No. 765,628, Sep. 25, 1991, abandoned, which is a division of Ser. No. 332,906, Apr. 3, 1989, Pat. No. 5,102,566, which is a continuation-in-part of Ser. No. 104,175, Oct. 2, 1987, abandoned.

[51] Int. Cl.[5] ..... C10M 161/00; C10M 145/08

[52] U.S. Cl. ..... 252/32.7 E; 252/51.5 A; 252/51.5 R

[58] Field of Search ..... 252/32.7 E, 51.5 A, 252/51.5 R

[56] References Cited

U.S. PATENT DOCUMENTS 2,389,527 11/1945 McCleary ..... 252/46.7
2,713,557 7/1955 Lowe ..... 252/32.7 E (List continued on next page.)

FOREIGN PATENT DOCUMENTS 1048994 2/1979 Canada .
0092946 4/1983 European Pat. Off. .
0024146 10/1985 European Pat. Off. .
0209730 6/1986 European Pat. Off. .
0310366 9/1988 European Pat. Off. .
47-34908 9/1972 Japan .
1153269 3/1968 United Kingdom .
1404714 1/1973 United Kingdom .
1376881 12/1974 United Kingdom .
2062672 5/1981 United Kingdom .
8604602 8/1986 World Int. Prop. O. .
8606092 10/1986 World Int. Prop. O. .

OTHER PUBLICATIONS

R. D. Hercamp, *SAE Technical Paper Series*, "Premature Loss of Oil Consumption Control in a Heavy Duty Diesel Engine," Fuels and Lubricants Meeting, San Francisco, Calif., Oct. 31-Nov. 3, 1983, Paper No. 831720.

J. A. McGeehan, *Society of Automotive Engineers, Inc.*, "Effect of Piston Deposits, Fuel Sulfur, and Lubricant Viscosity on Diesel Engine Oil Consumption and Cylinder Bore Polishing," 1984, pp. 4.848-4.869.

Alan A. Schetelich *SAE Technical Paper Series*, "The Effect of Lubricating Oil Parameters on PC-1 Type Heavy Duty Performance," Fuels and Lubricants Meeting, San Francisco, Calif., Oct. 31-Nov. 3, 1983, Paper No. 831721.

Schetelich, et al., The Control of Piston Crownland Deposits in Diesel Enginees Through Oil Formulation, Oct. 6-9, 1986.

McGeehan, et al., Some Effects of Zinc Dithiophosphates and Detergents on Controlling Engine Wear, 1986, pp. 879-892.

McGeehan, Effect of Piston Deposits, Fuel Sulfur, and Lubricant Viscosity on Diesel Engine Oil Consumption and Cylinder Bore Polishing, 1984, pp. 4.848.

*Primary Examiner*—Jacqueline V. Howard
*Attorney, Agent, or Firm*—J. B. Murray, Jr.; M. M. Allen

[57] ABSTRACT

In accordance with the present invention, there are provided low sulfated ash lubricating oil compositions which comprise an oil of lubricating viscosity as the major component and as the minor component (A) at least about 2 wt % of at least one ashless nitrogen- or ester-containing dispersant, (B) an antioxidant effective amount of at least one oil soluble antioxidant material, and (C) at least one oil soluble dihydrocarbyl dithiophosphate antiwear material wherein the hydrocarbyl groups contain an average of at least 3 carbon atoms, and wherein the lubricating oil is characterized by a total sulfated ash (SASH) level of from 0.01 to about 0.6 wt % and by a SASH wt:dispersant wt ratio of from about 0.01 to about 0.2:1.

41 Claims, 1 Drawing Sheet

U.S. PATENT DOCUMENTS 3,018,247 1/1962 Anderson et al. ..... 252/32.7
3,018,250 1/1962 Anderson et al. ..... 252/51.5
3,018,291 1/1962 Anderson et al. ..... 260/326.5
3,215,632 11/1965 Hughes et al. ..... 252/51.5
3,239,462 3/1966 Bergstrom et al. ..... 252/33.6
3,272,746 9/1966 Le Suer et al. ..... 252/47.5
3,285,854 11/1966 Malone ..... 252/46.7
3,320,163 5/1967 Abbott et al. ..... 252/48.2
3,519,564 7/1970 Vogel ..... 252/47.5
3,533,943 10/1970 Papayannopoulos ..... 252/32.7
3,714,042 1/1973 Greenough ..... 252/33.2
3,766,207 10/1973 McDermett ..... 252/32.7 E
3,853,774 12/1974 Crocker ..... 252/33.4
3,865,739 2/1975 Waldbillig ..... 252/47
3,869,395 3/1975 Waldbillag ..... 252/47
3,879,306 4/1975 Kablaoui et al. ..... 252/51.5
3,904,537 9/1975 Ripple ..... 252/47.5
4,048,056 9/1977 Romovacek ..... 208/41
4,089,790 5/1978 Adams ..... 252/18
4,089,791 5/1978 Haugen et al. ..... 252/32.7 E
4,089,794 5/1978 Engel et al. ..... 252/51.5 A
4,104,179 8/1978 Colclough ..... 252/32.7 E
4,113,639 9/1978 Lonstrup et al. ..... 252/51.5 A
4,115,287 9/1978 Colclough et al. ..... 252/48.2
4,123,369 10/1978 Miller et al. ..... 252/32.7
4,136,043 1/1979 Davis ..... 252/47.5
4,140,643 2/1979 Davis ..... 252/47.5
4,147,640 4/1979 Jayne et al. ..... 252/45
4,153,562 5/1979 Jaruzelski ..... 252/46.6
4,157,972 6/1979 Hotten ..... 252/51.5 A
4,163,729 8/1979 Adams ..... 252/18
4,164,473 8/1979 Coupland et al. ..... 252/32.7 E
4,165,292 8/1979 Davis et al. ..... 252/51.5 A
4,173,540 11/1979 Longstrup et al. ..... 252/49.6
4,178,259 12/1979 King ..... 252/42.7
4,192,757 3/1990 Brewster ..... 252/32.7 E
4,201,683 5/1980 Brewster ..... 252/32.7 E
4,219,430 8/1980 Vaughan ..... 252/42.7
4,246,126 1/1981 Aakelian et al. ..... 252/47.5
4,248,720 2/1981 Coupland ..... 252/32.7 E
4,282,106 8/1982 Schaap ..... 252/32.7 E
4,330,420 5/1982 White et al. ..... 252/32.7 E
4,372,862 2/1983 Miller ..... 252/33
4,375,418 3/1983 Zoleski et al. ..... 252/33.4
4,382,005 5/1983 Miller ..... 252/32.7 E
4,382,005 5/1983 Miller ..... 252/32.7
4,427,560 1/1984 Holstedt et al. ..... 252/42.7
4,502,970 3/1985 Schetelich et al. ..... 252/32.7 E
4,517,104 5/1985 Bloch et al. ..... 252/51.5 A
4,533,480 8/1985 Holstedt et al. ..... 252/46.4
4,557,843 12/1985 Holstedt et al. ..... 252/46.4
4,595,514 1/1986 Holstedt et al. ..... 252/46.4
4,612,129 9/1986 DiBiase et al. ..... 252/33.6
4,623,474 11/1986 Holstedt et al. ..... 252/47.5
4,627,930 12/1986 Holstedt et al. ..... 252/49.6
4,629,579 12/1986 Jessup et al. ..... 252/33.6
4,629,580 12/1986 Holstedt et al. ..... 252/49.6
4,639,324 1/1987 Lam ..... 252/48.6
4,657,686 4/1987 Holstedt et al. ..... 252/47.5
4,683,069 7/1987 Brewster et al. ..... 252/32.7 E
5,141,657 8/1992 Fellerman, Jr. et al. ..... 252/32.7 E

LOW ASH LUBRICANT COMPOSITIONS FOR INTERNAL COMBUSTION ENGINES

CROSS-REFERENCE TO RELATED APPLICATIONS

This is a continuation of application Ser. No. 765,628, filed Ser. 25, 1991, now abandoned, which is a Rule 60 divisional of U.S. Ser. No. 332,906 filed Apr. 3, 1989 now U.S. Pat. No. 5,102,566 which is a continuation-in-part of U.S. Ser. No. 104,175 filed Oct. 2, 1987, now abandoned.

This application is also related to co-pending application, Ser. No. 359,961, filed Jun. 1, 1989, now U.S. Pat. No. 5,141,657 which is a continuation of Ser. No. 104,175, which is now abandoned.

FIELD OF THE INVENTION

This invention relates to lubricating oil compositions which exhibit marked reduction in engine carbon deposits. More particularly, this invention is directed to low total sulfated ash lubricating oil compositions which are adapted for use in diesel engines and which contain high molecular weight ashless dispersants, oil soluble antioxidants and oil soluble dihydrocarbyl dithiophosphates.

BACKGROUND OF THE INVENTION

It is an objective of the industry to provide lubricating oil compositions which exhibit improvements in minimized engine deposits and low rates of lubricating oil consumption, particularly in diesel engine vehicles.

Among the conventionally used lubricating oil additives, zinc dihydrocarbyl dithiophosphates perform multiple functions in the motor oil, namely, oxidation inhibition, bearing corrosion inhibition, and extreme pressure/antiwear protection for the valve train.

Early patents illustrated compositions using polyisobutenylsuccinimide dispersants in combination with zinc dialkyldithiophosphates which were employed in lubricating oil compositions with other conventional additives such as detergents, viscosity index improvers, rust inhibitors and the like. Typical of these early disclosures are U.S. Pat. Nos. 3,018,247, 3,018,250 and 3,018,291.

Since phosphorus is a catalyst poison for catalytic converters, and since the zinc itself offers a source for sulfated ash, the art has sought to reduce or eliminate such zinc-phosphorus-containing motor oil components. Exemplary of prior art references directed to the reduction in phosphorus-containing lubricant additives are U.S. Pat. Nos. 4,147,640; 4,330,420; and 4,639,324.

U.S. Pat. No. 4,147,640 relates to lubricating oils having improved antioxidant and antiwear properties which are obtained by reacting an olefinic hydrocarbon having from 6 to 8 carbon atoms and about 1 to 3 olefinic double bonds concurrently with sulfur and hydrogen sulfide and thereafter reacting the resulting reaction intermediate with additional olefin hydrocarbon. These additives are disclosed to be generally used in conjunction with other conventional oil additives such as overbased metal detergents, polyisobutenylsuccinimide dispersants, and phenolic antioxidants. While it is disclosed that the amount of the zinc additive can be greatly reduced, giving a "low ash" or "no ash" lubricant formulation, it is apparent the patentee was referring to Zn-derived ash, and not total SASH levels.

U.S. Pat. No. 4,330,420 relates to low ash, low phosphorus motor oils having improved oxidation stability as a result the inclusion of synergistic amounts of dialkyldiphenylamine antioxidant and sulfurized polyolefin. It is disclosed that the synergism between these two additives compensates for the decreased amounts of phosphorus in the form of zinc dithiophosphate. The fully formulated motor oils are said to comprise 2 to 10 wt. % of ashless dispersant, 0.5 to 5 wt. % of recited magnesium or calcium detergent salts (to provide at least 0.1% of magnesium or calcium), from 0.5 to 2.0 wt. % of zinc dialkyldithiophosphate; from 0.2 to 2.0 wt. % of a dialkyldiphenolamine antioxidant; from 0.2 to 4 wt. % of a sulfurized polyolefin antioxidant; from 2 to 10 wt. % of a first, ethylene propylene VI improver; from 2 to 10 wt. % of a second VI improver consisting of methacrylate terpolymer, and the balance baseoil.

U.S. Pat. No. 4,639,324 discloses that metal dithiophosphate salts, while useful as antioxidants, are a source of ash, and discloses an ashless antioxidant comprising a reaction product made by reacting at least one aliphatic olefinically unsaturated hydrocarbon having from 8 to 36 carbons concurrently with sulfur and at least one fatty acid ester to obtain a reaction intermediate which is then reacted with additional sulfur and a dimer of cyclopentadiene or lower $C_1$ to $C_4$ alkyl substituted cyclopentadiene dimers. It is disclosed that these additives in lubricating compositions are generally used in conjunction with other conventional oil additives such as neutral and overbased calcium or magnesium alkaryl sulfonates, dispersants and phenolic antioxidants. It is disclosed that when using the additives of this invention, the amount of the zinc additive can be greatly reduced giving a "low ash" or "no ash" lubricant formulation. Again, it is apparent that the patentee was referring to Zn-derived ash, and not to total SASH.

Metal detergents have been heretofore employed in motor oils to assist in controlling varnish formation and corrosion, and to thereby minimize the adverse impact which varnish and corrosion have upon the efficiency of an internal combustion engine by minimizing the clogging of restricted openings and the reduction in the clearance of moving parts.

U.S. Pat. No. 4,089,791 relates to low ash mineral lubricating oil compositions comprising a mineral oil base in minor amounts of an overbased alkaline earth metal compound, a zinc dihydrocarbyl dithiphosphate (ZDDP) and a substituted trialkanolamine compound, wherein at least 50% of the ZDDP compounds consists of zinc dialkaryl dithiophosphates, in order to provide a formulated motor oil which will pass the MS IIC Rust Test and the L-38 Bearing Weight Loss Test. The patent illustrates three oil formulations, containing overbased calcium detergent, ZDDP, trialkanolamine and unspecified conventional lubricating oil additives to provide viscosity index improvement, antioxidant, dispersant and anti-foaming properties. The illustrated formulations each had about 0.66 wt. % SASH levels, based on the reported Ca and Zn concentrations. No diesel motor oil formulations are illustrated.

U.S. Pat. No. 4,153,562 relates to antioxidants, which are disclosed to be particularly useful for compounded lubricating oils that are intended for heavy duty use in automotive crankcase formulations of relatively low ash content, wherein the antioxidants are prepared by the condensation of phosphorodithioates of alkylphenol sulfides with unsaturated compounds such as styrene. The antioxidants are exemplified at levels of from 0.3 to 1.25 wt. % in lube oil compositions (Example 3) which also contain about 2.65 wt. % (a.i.) borated polyisobutenylsuccinimide dispersant, about 0.06 wt. % Mg as overbased magnesium sulfonate detergent inhibitor, and about 0.10 wt. % Zn as zinc dialkyldithiophosphate antiwear agent (containing mixed $C_4/C_5$ alkyl groups).

U.S. Pat. No. 4,157,972 indicates that the trend to unleaded fuels and ashless lubricating compositions has necessitated the search for non-metallic (ashless) substitutes for metallo-organo detergents, and relates to tetrahydropyrimidyl-substituted compounds which are disclosed to be useful as ashless bases and rust inhibitors. The examples of the patent compare the performance of various lubricating oil formulations in a Ford V8 varnish test (Table I) and additional formulations, which are named as either "low-ash" or "ashless", in a Humidity Cabinet Rust Test (Table II). The SASH levels of the "low ash" formulations are not reported and cannot be determined from the information given for the metal detergent- and Z DDP-components.

U.S. Pat. No. 4,165,292 discloses that overbased metal compounds provide effective rust inhibition in automotive crankcase lubricants and that in the absence of overbased additives, as in ashless oils, or when such additives are present in reduced amounts, as in "low ash" oils, rusting becomes a serious problem. Such rust requirements are evaluated by ASTM Sequence IIC engine-tests. The patent discloses a non-ash forming corrosion or rust inhibitor comprising a combination of an oil-soluble basic organic nitrogen compound (having a recited basicity value) and an alkenyl or alkyl substituted succinic acid having from 12 to 50 carbon atoms. The basic organic nitrogen compound and the carboxylic acid compound are required to be used together to achieve the desired rust-inhibiting properties. It is disclosed that best results are achieved by use of an excess of amine over that required to form the neutral salts of the substituted succinic acid present.

U.S. Pat. No. 4,502,970 relates to improved crankcase lubricating oil compositions containing lubricating oil dispersant, overbased metal detergent, zinc dialkyldithiophosphate antiwear additive and polyisobutenylsuccinic anhydride, in recited amounts. Exemplary lubricating oil formulations are disclosed containing 3 wt. % polyisobutenylsuccinimide dispersant, polyisobutenylsuccinic anhydride, overbased metal sulfonate or overbased sulfurized phenate detergents and zinc dialkyldithiophosphate antiwear agents, in base oil, in amounts of 3.0, 3.0, 2.0, 1.0 and 91.0 wt. %, respectively.

European Patent 24,146 relates to lubricating oil compositions containing copper antioxidants, and exemplifies copper antioxidants in lubricating oil compositions also containing 1.0 wt. % of a 400 TBN magnesium sulphonate (containing 9.2 wt. % magnesium), 0.3 wt. % of a 250 TBN calcium phenate (containing 9.3 wt. % of calcium) and a zinc dialkyldithiophosphate in which the alkyl groups or a mixture of such groups having between 4 and 5 carbon atoms and made by reacting phosphorous $P_2S_5$ with a mixture of about 65% isobutyl alcohol and 35% of amyl alcohol, to give a phosphorous level of 1.0 wt. % in lubricating oil composition.

Published British Patent Application 2,062,672 relates to additive compositions comprising sulfurized alkyl phenol and an oil soluble carboxylic dispersant containing a hydrocarbon-based radical having a number average molecular weight of at least 1300, which is disclosed in combination with ash-producing detergents.

However, it is extremely difficult to translate lube oil developments intended for passenger car and light truck service, whether gasoline or light duty diesel engines, into lubricating oils intended for use in heavy duty diesel service.

R. D. Hercamp, SAE Technical Paper Series, Paper No. 831720 (1983) reports development work on engine test procedures to measure the relative ability of various lubricant formulations to control oil consumption in heavy duty diesel engines. The author indicates that lab analysis of crown land deposits on the diesel engine pistons show an organic binder to be present which contains high molecular weight esters, and the author speculates that oxidation products in the oil may be precursors for the binder found in the deposits. It is indicated that improved antioxidants could be the key to prevent premature loss of oil consumption.

A. A. Schetelich, SAE Technical Paper Series, Paper No. 831722 (1983) reports on the effect of lubricating oil parameters on PC-1 type heavy duty diesel lubricating oil performance. It is noted that over the past 30 years, the trend in heavy duty diesel oil industry has been to decrease the sulfated ash levels from 2.5 wt. % sulfated ash (SASH) in 1960 to the typical North American SASH level of 0.8 to 1 wt. %, and to correspondingly decrease the HD oils total base number (TBN) D2896 values from over 20 to the present typical North American TBN values of from 7 to 10. Such reductions in SASH and TBN levels are attributed by the author to be due to improvement in performance of ashless components, including ashless diesel detergents and ashless dispersants. In diesel engine tests, no significant correlation was seen between the level of either piston deposits or oil consumption and the SASH or TBN levels, for about 1% to 2% SASH levels and about 8 to 17% TBN levels. In contrast, a significant correlation was seen between the level of ashless component treat and the amount of piston deposits (at the 92% confidence level) and oil consumption (at the 98% confidence level). It is noted by the authors that this correlation is drawn with respect to diesel fuels having average sulfur levels of less than about 0.5%. It is indicated that the level of buildup of ash is accelerated in the hotter engine areas. The author concludes that at the 97% confidence level there should be a correlation between oil consumption and piston deposits, especially top land deposits, which are believed to contribute to increased oil consumption due to two phenomena: (1) these deposits decrease the amount of blow-by flowing downwardly past the top land, which results in a decreased gas loading behind the top ring of the piston, which in turn leads to higher oil consumption; and (2) increased bore polishing of the piston cylinder liner by the top land deposits which in turn contributes to higher oil consumption by migration of the oil into the firing chamber of the cylinder along the polished bore paths. Therefore, the Paper concluded that reduced ash in the oil should be sought to reduce top land deposits, and hence oil consumption.

This 1983 Schetelich paper reports formulation of 2 test oils, each containing about 1% SASH and having TBN levels of 10 and 9, respectively, wherein each formulated oil contained overbased metal detergent together with a zinc-source.

J. A. McGeeban, SAE Paper No. 831721, pp. 4,848–4,869 (1984) summarized the results of a series of heavy duty diesel engine tests to investigate the effect of top land deposits, fuel sulfur and lubricant viscosity on diesel engine oil consumption and cylinder bore polishing. These authors also indicated that excessive top land deposits cause high oil consumption and cylinder bore polishing, although they added that cylinder bore polishing is also caused in high sulfur fuels by corrosion in oils of low alkalinity value. Therefore, they concluded that oil should provide sufficient alkalinity to minimize the corrosive aspect of bore polishing. The authors reported that an experimental 0.01% sulfated ash oil, which was tested in a AVL-Mack TZ675 (turbocharged) 120-hour test in combination with a 0.2% fuel sulfur, provided minimum top land deposits and very low oil consumption, which was said to be due to the "very effective ashless inhibitor". This latter component was not further defined. Further, from the data presented by the author in FIG. 4 of this Paper, there do not appear to be oil consumption credits to reducing the ash level below 1%, since the oil consumption in the engine actually rose upon reducing the SASH from to 0.01%. This reinforces the author's view that a low, but significant SASH level is required for sufficient alkalinity to avoid oil consumption as a result of bore polishing derived from corrosive aspects of the oil.

McGeehah concluded that the deposits on the top land correlate with oil consumption but are not directly related to the lubricant sulfated ash, and commented that these deposits can be controlled by the crankcase oil formulation.

SUMMARY OF THE INVENTION

In accordance with the present invention, there are provided low sulfated ash, heavy duty diesel lubricating oil compositions which comprise an oil of lubricating viscosity as the major component and as the minor component (A) at least about 2 wt. % of at least one high molecular weight ashless dispersant, (B) an antioxidant effective amount of at least one oil soluble antioxidant, and (C) at least one oil soluble dihydrocarbyl dithiophosphate antiwear material, wherein the lubricating oil is characterized by a total sulfated ash (SASH) level of less than about 0.6 wt% SASH and by a SASH wt:ashless disperant wt ratio of from about 0.01 to about 0.2:1.

It has been surprisingly found that the low ash lubricating oils of this invention achieve greatly reduced crownland deposits in heavy duty diesel engines while maintaining the desired additional performance properties for commercially acceptable oils. In particular, this invention has been surprisingly found to provide low ash formulations which pass the modern high severity heavy duty diesel lubricating oil specification which went into effect in April, 1987, namely, the American Petroleum Institute's CE Specification. Therefore, the present invention provides a method for preparing a heavy duty diesel lubricating oil adapted for meeting the American Petroleum Institute CE specifications which comprises controlling the metal content of the oil to provide a total sulfated ash (SASH) level in said oil of less than about 0.6 wt. % and a SASH weight:ashless dispersant weight ratio of from 0.01:1 to about 0.2:1, and providing in said oil (A) at least about 2 wt. % of at least one high molecular weight ashless dispersant, (B) an antioxidant effective amount of at least one oil soluble antioxidant, and (C) an antiwear effective amount of at least one oil soluble dihydrocarbyl dithiophosphate material, wherein each of said hydrocarbyl group in said dithiophosphate has, on the average, at least 3 carbon atoms.

The present invention further provides a method for improving the performance of a heavy duty diesel lubricating oil adapted for use in a diesel engine provided with at least one tight top land piston, and preferably further adapted for being powered by a normally liquid fuel having a sulfur content of less than 1 wt. %, which comprises controlling the metal content of the oil to provide a total sulfated ash (SASH) level in said oil of less than about 0.6 wt. % and a weight ratio SASH:dispersant weight:weight ratio of from 0.01:1 to about 0.2:1, and providing in said oil (A) at least about 2 wt. % of at least one high molecular weight ashless dispersant, (B) an antioxidant effective amount of at least one oil soluble antioxidant, and (C) an antiwear effective amount of at least one oil soluble dihydrocarbyl dithiophosphate, wherein each of said hydrocarbyl group in said dithiophosphate has, on the average, at least 3 carbon atoms.

DETAILED DESCRIPTION OF THE INVENTION

Component A

Figure 1:
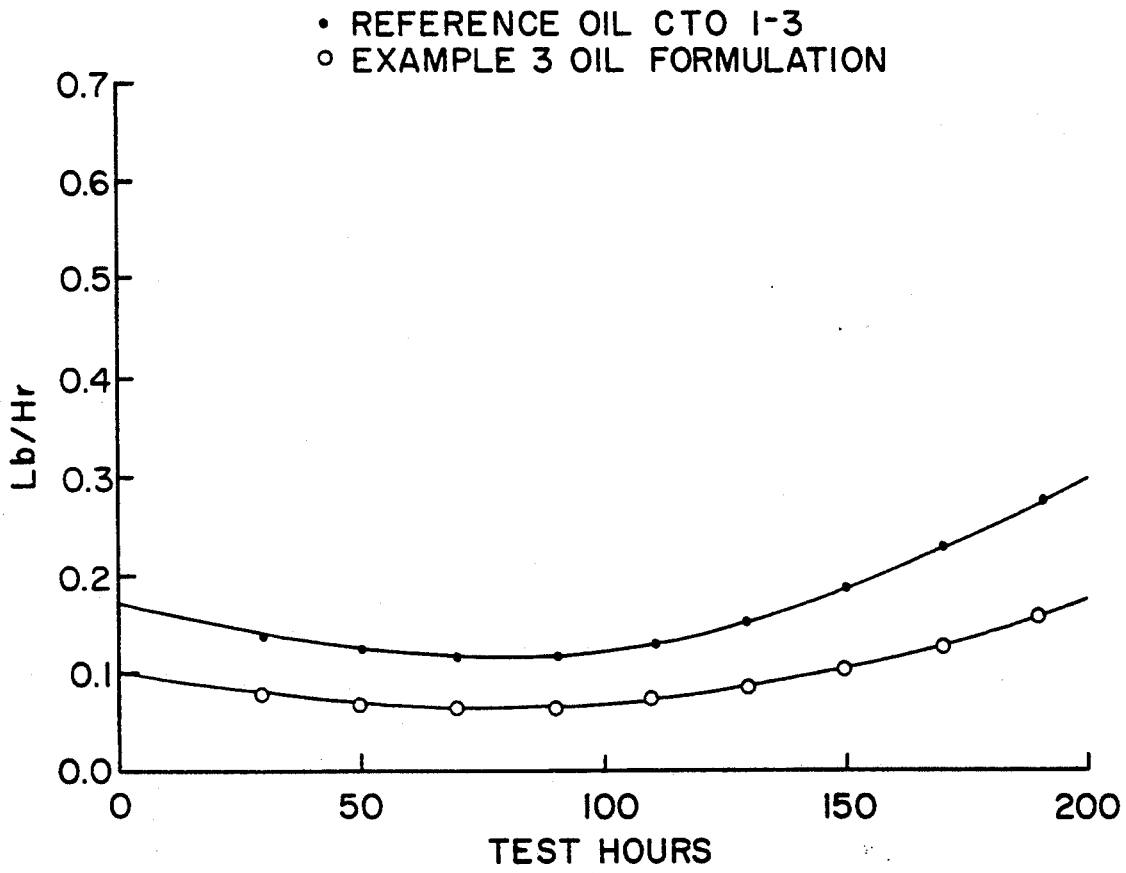
FIG. 1 is a plot of oil consumption versus test hours in a NTC-400 oil consumption test, as summarized in Example 3.

Ashless, nitrogen or ester containing dispersants useful in this invention comprise members selected from the group consisting of (i) oil soluble salts, amides, imides, oxazolines and esters, or mixtures thereof, of long chain hydrocarbon substituted mono and dicarboxylic acids or their anhydrides or esters; (ii) long chain aliphatic hydrocarbon having a polyamine attached directly thereto; (iii) Mannich condensation products formed by condensing about a molar proportion of long chain hydrocarbon substituted phenol with about 1 to 2.5 moles of formaldehyde and about 0.5 to 2 moles of polyalkylene polyamine; and (A)(ir) Mannich condensation products formed by reacting long chain hydrocarbon substituted mono- and dicarboxylic acids or their anhydrides or esters with an aminophenol, which may be optionally hydrocarbyl substituted, to form a long chain. hydrocarbon substituted amide or imide-containing phenol intermediate adduct, and condensing about a molar proportion of the long chain hydrocarbon substituted amide- or imide-containing phenol intermediate adduct with about 1 to 2.5 moles of formaldehyde and about 0.5 to 2 moles of polyamine wherein said long chain hydrocarbon group in (i), (ii) (iii) and(ir) is a polymer of a $C_2$ to $C_{10}$, e.g., $C_2$ to $C_5$ monoolefin, said polymer having a number average molecular weight of about 1,000 to about 5000.

A(i) The oil soluble salts, amides, imides, oxazoline and esters of long chain hydrocarbon substituted mono- and dicarboxylic acids or esters or anhydrides with a nucleophilic reactant selected from the group consisting of amines, alcohols, amino-alcohols and mixtures thereof. The long chain hydrocarbyl polymer-substituted mono- or dicarboxylic acid material, i.e. , acid, anhydride or acid ester used in this invention, includes the reaction product of a long chain hydrocarbon polymer, generally a polyolefin, with a monounsaturated carboxylic reactant comprising at least one member selected from the group consisting of (i) monounsaturated $C_4$ to $C_{10}$ dicarboxylic acid (preferably wherein (a) the carboxyl groups are vicinyl, (i.e. located on adjacent carbon atoms) and (b) at least one, preferably both, of said adjacent carbon atoms are part of said mono unsaturation); (ii) derivatives of (i) such as anhydrides or $C_1$ to $C_5$ alcohol derived mono- or di-esters of (i); (iii) monounsaturated $C_3$ to $C_{10}$ monocarboxylic acid wherein the carbon-carbon double bond is conjugated to the carboxy group, i.e, of the structure $$-C{=}C-\overset{\overset{\displaystyle O}{\|}}{C}-;$$

and (iv) derivatives of (iii) such as $C_1$ to $C_5$ alcohol derived monoesters of (iii). Upon reaction with the polymer, the monounsaturation of the monounsaturated carboxylic reactant becomes saturated. Thus, for example, maleic anhydride becomes a polymer substituted succinic anhydride, and acrylic acid becomes a polymer substituted propionic acid.

Typically, from about 0.7 to about 4.0 (e.g., 0.8 to 2.6) , preferably from about 1.0 to about 2.0, and most preferably from about 1.1 to about 1.7 moles of said monounsaturated carboxylic reactant are charged to the reactor per mole of polymer charged.

Normally, not all of the polymer reacts with the monounsaturated carboxylic reactant and the reaction mixture will contain non-acid substituted polymer. The polymer-substituted mono- or dicarboxylic acid material (also referred to herein as "functionalized" polymer or polyolefin), non-acid substituted polyolefin, and any other polymeric by-products, e.g. chlorinated polyolefin, (also referred to herein as "unfunctionalized" polymer) are collectively referred to herein as "product residue" or "product mixture". The non-acid substituted polymer is typically not removed from the reaction mixture (because such removal is difficult and would be commercially infeasible) and the product mixture, stripped of any monounsaturated carboxylic reactant is employed for further reaction with the amine or alcohol as described hereinafter to make the dispersant.

Characterization of the average number of moles of monounsaturated carboxylic reactant which have reacted per mole of polymer charged to the reaction (whether it has undergone reaction or not) is defined herein as functionality. Said functionality is based upon (i) determination of the saponification number of the resulting product mixture using potassium hydroxide; and (ii) the number average molecular weight of the polymer charged, using techniques well known in the art. Functionality is defined solely with reference to the resulting product mixture. Although the amount of said reacted polymer contained in the resulting product mixture can be subsequently modified, i.e. increased or decreased by techniques known in the art, such modifications do not alter functionality as defined above. The terms "polymer substituted monocarboxylic acid material" and "polymer substituted dicarboxylic acid material" as used herein are intended to refer to the product mixture whether it has undergone such modification or not.

Accordingly, the functionality of the polymer substituted mono- and dicarboxylic acid material will be typically at least about 0.5, preferably at least about 0.8, and most preferably at least about 0.9 and will vary typically from about 0.5 to about 2.8 (e.g., 0.6 to 2) , preferably from about 0.8 to about 1.4, and most preferably from about 0.9 to about 1.3.

Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, methyl fumarate, etc.

Preferred olefin polymers for reaction with the monounsaturated carboxylic reactants to form reactant A are polymers comprising a major molar amount of $C_2$ to $C_{10}$, e.g. $C_2$ to $C_5$ monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Mixtures of polymers prepared by polymerization of mixtures of isobutylene, butene-1 and butene-2, e.g. , polyisobutylene wherein up to about 40% of the monomer units are derived from butene-1 and butene-2, is an exemplary, and preferred, olefin polymer. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers used in the formation of reactant A will generally have number average molecular weights of from about 1,000 and about 5,000, preferably from about 1,150 to 4,000, more preferably from about 1300 and about 3,000, and still more preferably from about 1,500 and about 3,000. Particularly useful olefin polymers have number average molecular weights within the range of about 1300 and about 2,500 with approximately one terminal double bond per polymer chain. An especially useful starting material for highly potent dispersant additives useful in accordance with this invention is polyisobutylene, wherein up to about 40% of the monomer units are derived from butene-1 and/or butene-2. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

The olefin polymers will generally have a molecular weight distribution (the ratio of the weight average molecular weight to number average molecular weight, i.e. $\overline{M}_w/\overline{M}_n$) of from about 1.0 to 4.5, and more typically from about 1.5 to 3.0.

The polymer can be reacted with the monounsaturated carboxylic reactant by a variety of methods. For example , the polymer can be first halogenated, chlorinated or brominated to about 1 to 8 wt. %, preferably 3 to 7 wt. % chlorine, or bromine, based on the weight of polymer, by passing the chlorine or bromine through the polymer at a temperature of 60° to 250° C., preferably 110° to 160° C., e.g. 120° to 140° C., for about 0.5 to 10, preferably 1 to 7 hours. The halogenated polymer may then be reacted with sufficient monounsaturated carboxylic reactant at 100° to 250° C., usually about 180° to 235° C., for about 0.5 to 10, e.g. 3 to 8 hours, so the product obtained will contain the desired number of moles of the monounsaturated carboxylic reactant per mole of the halogenated polymer. Processes of this general type are taught in U.S. Pat. Nos. 3,087,436; 3,172,892; 3,272,746 and others. Alternatively, the polymer and the monounsaturated carboxylic reactant are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

Alternately, the polymer and the monounsaturated carboxylic reactant can be contacted at elevated temperature to cause a thermal "ene" reaction to take place. Thermal "ene" reactions have been heretofore described in U.S. Pat. Nos. 3,361,673 and 3,401,118, the disclosures of which are hereby incorporated by reference in their entirety.

Preferably, the polymers used in this invention contain less than 5 wt %, more preferably less than 2 wt %, and most preferably less than 1 wt % of a polymer fraction comprising polymer molecules having a molecular weight of less than about 300 as determined by high temperature gel permeation chromatography employing the corresponding polymer calibration curve. Such preferred polymers have been found to permit the preparation of reaction products, particularly when employing maleic anhydride as the unsaturated acid reactant, with decreased sediment. In the event the polymer produced as described above contains greater than about 5 wt % of such a low molecular weight polymer fraction, the polymer can be first treated by conventional means to remove the low molecular weight fraction to the desired level prior to initiating the ene reaction, and preferably prior to contacting the polymer with the selected unsaturated carboxylic reactant(s). For example, the polymer can be heated, preferably with inert gas (e.g., nitrogen) stripping, at elevated temperature under a reduced pressure to volatilize the low molecular weight polymer components which can then be removed from the heat treatment vessel. The precise temperature, pressure and time for such heat treatment can vary widely depending on such factors as the polymer number average molecular weight, the amount of the low molecular weight fraction to be removed, the particular monomers employed and other factors. Generally, a temperature of from about 60° to 100° C. and a pressure of from about 0.1 to 0.9 atmospheres and a time of from about 0.5 to 20 hours (e.g., 2 to 8 hours) will be sufficient.

In this process, the selected polymer and monounsaturated carboxylic reactant and halogen (e.g., chlorine gas), where employed, are contacted for a time and under conditions effective to form the desired polymer substituted mono- or dicarboxylic acid material. Generally, the polymer and monounsaturated carboxylic reactant will be contacted in a unsaturated carboxylic reactant to polymer mole ratio usually from about 0.7:1 to 4:1, and preferably from about 1:1 to 2:1, at an elevated temperature, generally from about 120° to 260° C., preferably from about 160° to 240° C. The mole ratio of halogen to monounsaturated carboxylic reactant charged will also vary and will generally range from about 0.5:1 to 4:1, and more typically from about 0.7:1 to 2:1 (e.g., from about 0.9 to 1.4:1). The reaction will be generally carried out, with stirring for a time of from about 1 to 20 hours, preferably from about 2 to 6 hours.

By the use of halogen, about 65 to 95 wt. % of the polyolefin, e.g. polyisobutylene will normally react with the monounsaturated carboxylic acid reactant. Upon carrying out a thermal reaction without the use of halogen or a catalyst, then usually only about 50 to 75 wt. % of the polyisobutylene will react. Chlorination helps increase the reactivity. For convenience, the aforesaid functionality ratios of mono- or dicarboxylic acid producing units to polyolefin, e.g., 1.1 to 1.8, etc. are based upon the total amount of polyolefin, that is, the total of both the reacted and unreacted polyolefin, used to make the product.

The reaction is preferably conducted in the substantial absence of $O_2$ and water (to avoid competing side reactions), and to this end can be conducted in an atmosphere of dry $N_2$ gas or other gas inert under the reaction conditions. The reactants can be charged separately or together as a mixture to the reaction zone, and the reaction can be carried out continuously, semi-continuously or batchwise. Although not generally necessary, the reaction can be carried out in the presence of a liquid diluent or solvent, e.g., a hydrocarbon diluent such as mineral lubricating oil, toluene, xylene, dichlorobenzene and the like. The polymer substituted mono- or dicarboxylic acid material thus formed can be recovered from the liquid reaction mixture, e.g. , after stripping the reaction mixture, if desired, with an inert gas such as $N_2$ to remove unreacted unsaturated carboxylic reactant.

If desired, a catalyst or promoter for reaction of the olefin polymer and monounsaturated carboxylic reactant (whether the olefin polymer and monounsaturated carboxylic reactant are contacted in the presence or absence of halogen (e.g., chlorine)) can be employed in the reaction zone. Such catalyst of promoters include alkoxides of Ti, Zr, V and Al, and nickel salts (e.g., Ni acetoacetonate and Ni iodide) which catalysts or promoters will be generally employed in an amount of from about 1 to 5,000 ppm by weight, based on the mass of the reaction medium.

Amine compounds useful as nucleophilic reactants for reaction with the hydrocarbyl substituted mono- and dicarboxylic acid materials are those containing at least two reactive amino groups, i.e., primary and secondary amino groups. They include polyalkylene polyamines of about 2 to 60, preferably 2 to 40 (e.g. 3 to 20), total carbon atoms and about 1 to 20, preferably 3 to 12, and most preferably 3 to 9 nitrogen atoms in the molecule. These amines may be hydrocarbyl amines or may be hydrocarbyl amines including other groups, e.g, hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formulas:

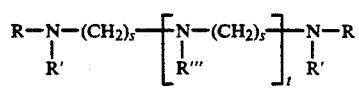

(I)

wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''' can additionally comprise a moiety of the formula:

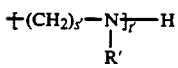

(II)

wherein R' is as defined above, and wherein s and s' can be the same or a different number of from 2 to 6, preferably 2 to 4; and t and t' can be the same or different and are numbers of from 0 to 10, preferably 2 to 7, and most preferably about 3 to 7, with the proviso that the sum of t and t' is not greater than 15. To assure a facile reaction, it is preferred that R, R', R'', R''', s, s', t and t' be selected in a manner sufficient to provide the compounds of Formula I with typically at least one primary or secondary amine group, preferably at least two primary or secondary amine groups. This can be achieved by selecting at least one of said R, R', R'' or R''' groups to be hydrogen or by letting t in Formula I be at least one when R''' is H or when the II moiety possesses a secondary amino group. The most preferred amine of the above formulas are represented by Formula I and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene)triamine; di- (1,3-propylene) triamine; N,N-dimethyl-1,3-diaminopropane; N,N-di-(2--aminoethyl) ethylene diamine; N,N-di (2-hydroxyethyl)-1,3--propylene diamine; 3-dodecyloxypropylamine; N-dodecyl-1,3-propane diamine; tris hydroxymethylaminomethane (THAM); diisopropanol amine: diethanol amine; triethanol amine; mono-, di-, and tri-tallow amines; amino morpholines such as N-(3-aminopropyl) morpholine; and mixtures thereof.

Other useful amine compounds include: alicyclic diamines such as 1,4-di (aminomethyl) cyclohexane, and heterocyclic nitrogen compounds such as imidazolines, and N-aminoalkyl piperazines of the general formula (III):

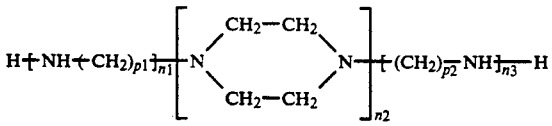

wherein $P_1$ and $P_2$ are the same or different and are each integers of from 1 to 4, and $n_1$, $n_2$ and $n_3$ are the same or different and are each integers of from 1 to 3. Non-limiting examples of such amines include 2-pentadecyl imidazoline; N-(2-aminoethyl) piperazine; etc.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and isomeric piperazines. Low cost poly(ethyleneamines) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

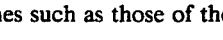

(IV)

where m has a value of about 3 to 70 and preferably 10 to 35; and

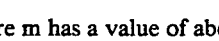

(V)

where "n" has a value of about 1 to 40 with the provision that the sum of all the n's is from about 3 to about 70 and preferably from about 6 to about 35, and R is a polyvalent saturated hydrocarbon radical of up to ten carbon atoms wherein the number of substituents on the R group is represented by the value of "a", which is a number of from 3 to 6. The alkylene groups in either formula (IV) or (V) may be straight or branched chains containing about 2 to 7, and preferably about 2 to 4 carbon atoms.

The polyoxyalkylene polyamines of formulas (IV) or (V) above, preferably polyoxyalkylene diamines and polyoxyalkylene triamines, may have average molecular weights ranging from about 200 to about 4000 and preferably from about 400 to about 2000. The preferred polyoxyalkylene polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

Additional amines useful in the present invention are described in U.S. Pat. No. 3,445,441, the disclosure of which is hereby incorporated by reference in its entirety.

A particularly useful class of amines are the polyamido and related amines disclosed in co-pending Ser. No. 126,405, filed Nov. 30, 1987, which comprise reaction products of a polyamine and an alpha, beta unsaturated compound of the formula:

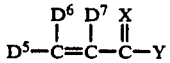

(VI)

wherein X is sul fur or oxygen, Y is $—OD^8$, $—SD^8$, or $—ND^8(D^9)$, and $D^5$, $D^6$, $D^7$, $D^8$ and $D^9$ same or different and are hydrogen or substituted or unsubstituted hydrocarbyl. Any polyamine, whether aliphatic, cycloaliphatic, aromatic, heterocyclic, etc., can be employed provided it is capable of adding across the acrylic double bond and amidifying with for example the carbonyl group (—C(O)—) of the acrylate-type compound of formula VI, or with the thiocarbonyl group (—C(S)—) of the thioacrylate-type compound of formula VI.

When $D^5$, $D^6$, $D^7$, $D^8$ or $D^9$ in Formula VI are hydrocarbyl, these groups can comprise alkyl, cycloalkyl, aryl, alkaryl, aralkyl or heterocyclic, which can be substituted with groups which are substantially inert to any component of the reaction mixture under conditions selected for preparation of the amido-amine. Such substituent groups include hydroxy, halide (e.g., Cl, F1, I, Br), —SH and alkylthio. When one or more of $D^5$ through $D^9$ are alkyl, such alkyl groups can be straight or branched chain, and will generally contain from 1 to 20, more usually from 1 to 10, and preferably from 1 to 4, carbon atoms. Illustrative of such alkyl groups are methyl, ethyl, propyl, butyl, pentyl, hexyl, heptyl, octyl, nonyl, decyl, dodecyl, tridecyl, hexadecyl, octadecyl and the like. When one or more of $D^5$ through $D^9$ are aryl, the aryl group will generally contain from 6 to 10 carbon atoms (e.g., phenyl, naphthyl).

When one or more of $D^5$ through $D^9$ are alkaryl, the alkaryl group will generally contain from about 7 to 20 carbon atoms, and preferably from 7 to 12 carbon atoms. Illustrative of such alkaryl groups are tolyl, m-ethylphenyl, o-ethyltolyl, and m-hexyltolyl. When one or more of $D^5$ through $D^9$ are aralkyl, the aryl component generally consists of phenyl or ($C_1$ to $C_6$) alkyl-substituted phenol and the alkyl component generally contains from 1 to 12 carbon atoms, and preferably from 1 to 6 carbon atoms. Examples of such aralkyl groups are benzyl, o-ethylbenzyl, and 4-isobutylbenzyl. When one or more of $D^5$ and $D^9$ are cycloalkyl, the cycloalkyl group will generally contain from 3 to 12 carbon atoms, and preferably from 3 to 6 carbon atoms. Illustrative of such cycloalkyl groups are cyclopropyl, cyclobutyl, cyclohexyl, cyclooctyl, and cyclododecyl. When one or more of $D^5$ through $D^9$ are heterocyclic, the heterocyclic group generally consists of a compound having at least one ring of 6 to 12 members in which on or more ring carbon atoms is replaced by oxygen or nitrogen. Examples of such heterocyclic groups are furyl, pyranyl, pyridyl, piperidyl, dioxanyl, tetrahydrofuryl, pyrazinyl and 1,4-oxazinyl.

The alpha, beta ethylenically unsaturated carboxylate compounds employed herein have the following formula:

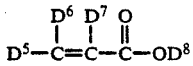

(VII)

wherein $D^5$, $D^6$, $D^7$, and $D^8$ are the same or different and are hydrogen or substituted or unsubstituted hydrocarbyl as defined above. Examples of such alpha, beta-ethylenically unsaturated carboxylate compounds of formula VII are acrylic acid, methacrylic acid, the methyl, ethyl, isopropyl, n-butyl, and isobutyl esters of acrylic and methacrylic acids, 2-butenoic acid, 2-hexenoic acid, 2-decenoic acid, 3-methyl-2-heptenoic acid, 3-methyl-2 -butenoic acid, 3-phenyl-2-propenoic acid, 3-cyclohexyl-2-butenoic acid, 2-methyl-2-butenoic acid, 2-propyl-2-propenoic acid, 2-isopropyl-2-hexenoic acid, 2,3-dimethyl-2-butenoic acid, 3-cyclohexyl-2-methyl-2-pentenoic acid, 2-propenoic acid, methyl 2-propenoate, methyl 2-methyl 2-propenoate, methyl 2-butenoate, ethyl 2-hexenoate, isopropyl 2-decenoate, phenyl 2-pentenoate, tertiary butyl 2-propenoate, octadecyl 2-propenoate, dodecyl 2-decenoate, cyclopropyl 2,3-dimethyl-2-butenoate, methyl 3-phenyl-2-propenoate, and the like.

The alpha, beta ethylenically unsaturated carboxylate thioester compounds employed herein have the following formula:

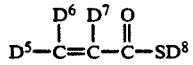

(VIII)

wherein $D^5$, $D^6$, $D^7$, and $D^8$ are the same or different and are hydrogen or substituted or unsubstituted hydrocarbyl as defined above. Examples of such alpha, beta-ethylenically unsaturated carboxylate thioesters of formula VIII are methylmercapto 2-butenoate, ethylmercapto 2-hexenoate, isopropylmercapto 2-decenoate, phenylmercapto 2-pentenoate, tertiary butylmercapto 2-propenoate, octadecylmercapto 2-propenoate, dodecylmercapto 2-decenoate, cyclopropylmercapto 2,3-dimethyl-2-butenoate, methylmercapto 3-phenyl-2-propenoate, methylmercapto 2-propenoate, methylmercapto 2-methyl-2-propenoate, and the like.

The alpha, beta ethylenically unsaturated carboxyamide compounds employed herein have the following formula:

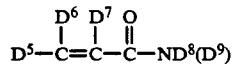

(IX)

wherein $D^5$, $D^6$, $D^7$, $D^8$ and $D^9$ are the same or different and are hydrogen or substituted or unsubstituted hydrocarbyl as defined above. Examples of alpha, beta-ethylenically unsaturated carboxyamides of formula IX are 2-butenamide, 2-hexenamide, 2-decenamide, 3-methyl-2-heptenamide, 3-methyl-2-butenamide, 3-phenyl-2-propenamide, 3-cyclohexyl-2-butenamide, 2-methyl-2-butenamide, 2-propyl-2-propenamide, 2-isopropyl-2-hexenamide, 2,3-dimethyl-2-butenamide, 3-cyclohexyl-2-methyl-2-pentenamide, N-methyl 2-butenamide, N-methyl 2-butenamide, N,N-diethyl 2-hexenamide, N-isopropyl 2-decenamide, N-phenyl 2-pentenamide, N-tertiary butyl 2-propenamide, N-octadecyl 2-propenamide, N-N-didodecyl 2-decenamide, N-cyclopropyl 2,3-dimethyl-2-butenamide, N-methyl 3-phenyl-2-propenamide, 2-propenamide, 2-methyl-2-propenamide, 2-ethyl-2-propenamide and the like.

The alpha, beta ethylenically unsaturated thiocarboxylate compounds employed herein have the following formula:

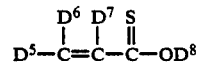

(X)

wherein $D^5$, $D^6$, $D^7$ and $D^8$ are the same or different and are hydrogen or substituted or unsubstituted hydrocarbyl as defined above. Examples of alpha, beta-ethylenically unsaturated thiocarboxylate compounds of formula X are 2-butenthioic acid, 2-hexenthioic acid, 2-decenthioic acid, 3-methyl-2-heptenthioic acid, 3-methyl-2-butenthioic acid, 3-phenyl-2-propenthioic acid, 3-cyclohexyl-2-butenthioic acid, 2-methyl-2-butenthioic acid, 2-propyl-2-propenthioic acid, 2-isopropyl-2-hexenthioic acid, 2,3-dimethyl-2-butenthioic acid, 3-cyclohexyl-2-methyl-2-pententhioic acid, 2-propenthioic.acid, methyl 2-propenthioate, methyl 2-methyl 2-propenthioate, methyl 2-butenthioate, ethyl 2-hexenthioate, isopropyl 2-decenthioate, phenyl 2-pententhioate, tertiary butyl 2-propenthioate, octadecyl 2-propenthioate, dodecyl 2-decenthioate, cyclopropyl 2,3-dimethyl-2-butenthioate, methyl 3-phenyl-2-propenthioate, and the like.

The alpha, beta ethylenically unsaturated dithioic acid and acid ester compounds employed herein have the following formula:

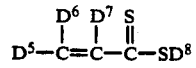

(XI)

wherein $D^5$, $D^6$, $D^7$, and $D^8$ are the same or different and are hydrogen or substituted or unsubstituted hydrocarbyl as defined above. Examples of alpha, beta-ethylenically unsaturated dithioic acids and acid esters of formula XI are 2-butendithioic acid, 2-hexendithioic acid, 2-decendithioic acid, 3-methyl-2-heptendithioic acid, 3-methyl-2-butendithioic acid, 3-phenyl-2 -propendithioic acid, 3-cyclohexyl-2-butendithioic acid, 2-methyl-2-butendithioic acid, 2-propyl-2-propendithioic acid, 2-isopropyl-2-hexendithioic acid, 2,3-dimethyl-2-butendithioic acid, 3-cyclohexyl-2-methyl-2-pentendithioic acid, 2-propendithioic acid, methyl 2-propendithioate, methyl 2-methyl 2-propendithioate, methyl 2-butendithioate, ethyl 2-hexendithioate, isopropyl 2-decendithioate, phenyl 2-pentendithioate, tertiary butyl 2-propendithioate, octadecyl 2-propendithioate, dodecyl 2-decendithioate, cyclopropyl 2 , 3-dimethyl-2-butendithioate, methyl 3-phenyl-2-propendithioate, and the like.

The alpha, beta ethylenically unsaturated thiocarboxyamide compounds employed herein have the following formula:

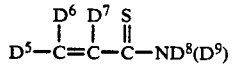

(XII)

wherein $D^5$, $D^6$, $D^7$, $D^8$ and $D^9$ are the same or different and are hydrogen or substituted or unsubstituted hydrocarbyl as defined above. Examples of alpha, beta-ethylenically unsaturated thiocarboxyamides of formula XII are 2-butenthioamide, 2-hexenthioamide, 2-decenthioamide, 3-methyl-2-heptenthioamide, 3-methyl-2-butenthioamide, 3-phenyl-2-propenthioamide, 3-cyclohexyl-2-butenthioamide, 2-methyl-2-butenthioamide, 2-propyl-2-propenthioamide, 2-isopropyl-2-hexenthioamide, 2,3-dimethyl-2-butenthioamide, 3-cyclohexyl-2-methyl-2-pententhioamide, N-methyl 2-butenthioamide, N,N-diethyl 2-hexenthioamide, N-isopropyl 2-decenthioamide, N-phenyl 2-pententhioamide, N-tertiary butyl 2-propenthioamide, N-octadecyl 2-propenthioamide, N-N-didodecyl 2-decenthioamide , N-cyclopropyl 2,3-dimethyl-2-butenthioamide, N-methyl 3-phenyl-2-propenthioamide, 2-propenthioamide, 2-methyl-2-propenthioamide, 2-ethyl-2-propenthioamide and the like.

Preferred compounds for reaction with the polyamines in accordance with this invention are lower alkyl esters of acrylic and (lower alkyl) substituted acrylic acid. Illustrative of such preferred compounds are compounds of the formula:

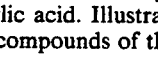

(XIII)

where $D^7$ is hydrogen or a $C_1$ to $C_4$ alkyl group, such as methyl, and $D^8$ is hydrogen or a $C_1$ to $C_4$ alkyl group, capable of being removed so as to form an amido group, for example, methyl, ethyl, propyl, isopropyl, butyl, sec-butyl, tert-butyl, aryl, hexyl, etc. In the preferred embodiments these compounds are acrylic and methacrylic esters such as methyl or ethyl acrylate, methyl or ethyl methacrylate.

When the selected alpha, beta-unsaturated compound comprises a compound of formula VI wherein X is oxygen, the resulting reaction product with the polyamine contains at least one amido linkage (—C(O)N<) and such materials are herein termed "amido-amines." Similarly, when the selected alpha, beta unsaturated compound of formula VI comprises a compound wherein X is sulfur, the resulting reaction product with the polyamine contains thioamide linkage (—C(S)N<) and these materials are herein termed "thioamido-amines." For convenience, the following discussion is directed to the preparation and use of amido-amines, although it will be understood that such discussion is also applicable to the thioamido-amines.

The type of amido-amine formed varies with reaction conditions. For example, a more linear amido-amine is formed where substantially equimolar amounts of the unsaturated carboxylate and polyamine are reacted. The presence of excesses of the ethylenically unsaturated reactant of formula VI tends to yield an amido-amine which is more cross-linked than that obtained where substantially equimolar amounts of reactants are employed. Where for economic or other reasons a cross-linked amido-amine using excess amine is desired, generally a molar excess of the ethylenically unsaturated reactant of about at least 10%, such as 10–300%, or greater, for example, 25–200%, is employed. For more efficient cross-linking an excess of carboxylated material should preferably be used since a cleaner reaction ensues. For example, a molar excess of about 10–100% or greater such as 10–50%, but preferably an excess of 30–50%, of the carboxylated material. Larger excess can be employed if desired.

In summary, without considering other factors, equimolar amounts of reactants tend to produce a more linear amido-amine whereas excess of the formula VI reactant tends to yield a more cross-linked amido-amine. It should be noted that the higher the polyamine (i.e., in greater the number of amino groups on the molecule) the greater the statistical probability of cross-linking since, for example, a tetraalkylenepentamine, such as tetraethylene pentamine

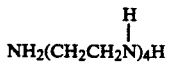

has more labile hydrogens than ethylene diamine.

These amido-amine adducts so formed are characterized by both amido and amino groups. In their simplest embodiments they may be represented by units of the following idealized formula (XIV):

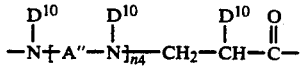

wherein the $D^{10}$'s, which may be the same or different, are hydrogen or a substituted group, such as a hydrocarbon group, for example, alkyl, alkenyl, alkynyl, aryl, etc., and A" is a moiety of the polyamine which, for example, may be aryl, cycloalkyl, alkyl, etc., and $n_4$ is an integer such as 1-10 or greater.

The above simplified formula represents a linear amido-amine polymer. However, cross-linked polymers may also be formed by employing certain conditions since the polymer has labile hydrogens which can further react with either the unsaturated moiety by adding across the double bond or by amidifying with a carboxylate group.

Preferably, however, the amido-amines employed in this invention are not cross-linked to any substantial degree, and more preferably are substantially linear.

Preferably, the polyamine reactant contains at least one primary amine (and more preferably from 2 to 4 primary amines) group per molecule, and the polyamine and the unsaturated reactant of formula VI are contacted in an amount of from about 1 to 10, more preferably from about 2 to 6, and most preferably from about 3 to 5, equivalents of primary amine in the polyamine reactant per mole of the unsaturated reactant of formula VI.

The reaction between the selected polyamine and acrylate-type compound is carried out at any suitable temperature. Temperatures up to the decomposition points of reactants and products can be employed. In practice, one generally carries out the reaction by heating the reactants below 100° C., such as 80°-90° C., for a suitable period of time, such as a few hours. Where an acrylic-type ester is employed, the progress of the reaction can be judged by the removal of the alcohol in forming the amide.

During the early part of the reaction alcohol is removed quite readily below 100° C. in the case of low boiling alcohols such as methanol or ethanol. As the reaction slows, the temperature is raised to push the polymerization to completion and the temperature may be raised to 150° C. toward the end of the reaction. Removal of alcohol is a convenient method of judging the progress and completion of the reaction which is generally continued until no more alcohol is evolved. Based on removal of alcohol, the yields are generally stoichiometric. In more difficult reactions, yield of at least 95% are generally obtained.

Similarly, it will be understood that the reaction of an ethylenically unsaturated carboxylate thioester of formula VIII liberates the corresponding $HSD^8$ compound (e.g., $H_2S$ when $D^8$ is hydrogen) as a by-product, and the reaction of an ethylenically unsaturated carboxyamide of formula IX liberates the corresponding $HND^8(D^9)$ compound (e.g., ammonia when $D^8$ and $D^9$ are each hydrogen) as by-product.

The amine is readily reacted with the dicarboxylic acid material, e.g. alkenyl succinic anhydride, by heating an oil solution containing 5 to 95 wt. % of dicarboxylic acid material to about 100° to 200° C., preferably 125° to 175° C., generally for 1 to 10, e.g. 2 to 6 hours until the desired amount of water is removed. The heating is preferably carried out to favor formation of imides or mixtures of imides and amides, rather than amides and salts. Reaction ratios of dicarboxylic acid material to equivalents of amine as well as the other nucleophilic reactants described herein can vary considerably, depending upon the reactants and type of bonds formed. Generally from 0.1 to 1.0, preferably about 0.2 to 0.6, e.g. 0.4 to 0.6, moles of dicarboxylic acid moiety content (e.g. grafted maleic anhydride content) is used, per equivalent of nucleophilic reactant, e.g. amine. For example, about 0.8 mole of a pentamine (having two primary amino groups and 5 equivalents of nitrogen per molecule) is preferably used to convert into a mixture of amides and imides, the product formed by reacting one mole of olefin with sufficient maleic anhydride to add 1.6 moles of succinic anhydride groups per mole of olefin, i.e. preferably the pentamine is used in an amount sufficient to provide about 0.4 mole (that is $1.6/[0.8\times5]$ mole) of succinic anhydride moiety per nitrogen equivalent of the amine.

Tris(hydroxymethyl) amino methane (THAM) can be reacted with the aforesaid acid material to form amides, imides or ester type additives as taught by U.K. 984,409, or to form oxazoline compounds and borated oxazoline compounds as described, for example, in U.S. Pat. No. 4,102,798; 4,116,876 and 4,113,639.

The adducts may also be esters derived from the aforesaid long chain hydrocarbon substituted dicarboxylic acid material and from hydroxy compounds such as monohydric and polyhydric alcohols or aromatic compounds such as phenols and naphthols, etc. The polyhydric alcohols are the most preferred hydroxy compounds. Suitable polyol compounds which can be used include aliphatic polyhydric alcohols containing up to about 100 carbon atoms and about 2 to about 10 hydroxyl groups. These alcohols can be quite diverse in structure and chemical composition, for example, they can be substituted or unsubstitued, hindered or unhindered, branched chain or straight chain, etc. as desired. Typical alcohols are alkylene glycols such as ethylene glycol, propylene glycol, trimethylene glycol, butylene glycol, and polyglycol such as diethylene glycol, triethylene glycol, tetraethylene glycol, dipropylene glycol, tripropylene glycol, dibutylene glycol, tributylene glycol, and other alkylene glycols and polyalkylene glycols in which the alkylene radical contains from two to about eight carbon atoms. Other useful polyhydric alcohols include glycerol, monomethyl ether of glycerol, pentaerythritol, dipentaerythritol, tripentaerythritol, 9,10-dihydroxystearic acid, the ethyl ester of 9,10-dihydroxystearic acid, 3-chloro-1,2-propanediol, 1,2-butanediol, 1,4-butanediol, 2,3-hexanediol, pinacol, tetrahydroxy pentane, erythritol, arabitol, sorbitol, mannitol, 1,2-cyclohexanediol, 1,4-cyclohexanediol, 1,4-(2-hydroxyethyl)-cyclohexane, 1,4-dihydroxy-2-nitrobutane, 1,4-di-(2-hydroxyethyl)-benzene, the carbohydrates such as glucose, rhamnose, mannose, glyceraldehyde, and galactose, and the like, amino alcohols such as di-(2-hydroxyethyl) amine, tri-(3 hydroxypropyl) amine, N,N,-di-(hydroxyethyl) ethylenediamine, copolymer of allyl alcohol and styrene, N,N-di-(2-hydroxylethyl) glycine and esters thereof with lower mono- and polyhydric aliphatic alcohols etc.

Included within the group of aliphatic alcohols are those alkane polyols which contain ether groups such as polyethylene oxide repeating units, as well as those polyhydric alcohols containing at least three hydroxyl groups, at least one of which has been esterified with a mono-carboxylic acid having from eight to about 30 carbon atoms such as octanoic acid, oleic acid, stearic acid, linoleic acid, dodecanoic acid, or tall oil acid. Examples of such partially esterified polyhydric alcohols are the mono-oleate of sorbitol, the mono-oleate of glycerol, the mono-stearate of glycerol, the di-stearate of sorbitol, and the di-dodecanoate of erythritol.

A preferred class of ester containing adducts are those prepared from aliphatic alcohols containing up to 20 carbon atoms, and especially those containing three to 15 carbon atoms. This class of alcohols includes glycerol, erythritol, pentaerythritol, dipentaerythritol, tripentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis (hydroxymethyl)-cyclohexanol, 1,10-decanediol, digitalose, and the like. The esters prepared from aliphatic alcohols containing at least three hydroxyl groups and up to fifteen carbon atoms are particularly preferred.

An especially preferred class of polyhydric alcohols for preparing the ester adducts used as starting materials in the present invention are the polyhydric alkanols containing 3 to 15, especially 3 to 6 carbon atoms and having at least 3 hydroxyl groups. Such alcohols are exemplified in the above specifically identified alcohols and are represented by glycerol, erythritol, pentaerythritol, mannitol, sorbitol, 1,2,4 hexanetriol, and tetrahydroxy pentane and the like.

The ester adducts may be di-esters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester adduct may be prepared by one of several known methods as illustrated for example in U.S. Pat. No. 3,381,022. The ester adduct may also be borated, similar to the nitrogen containing adduct, as described herein.

Hydroxyamines which can be reacted with the aforesaid long chain hydrocarbon substituted dicarboxylic acid material to form adducts include 2-amino-2-methyl-1-propanol, p-(beta-hydroxyethyl)-aniline, 2-amino-1-propanol, 3-amino-l-propanol, 2-amino-2-methyl-1,3-propane-diol, 2-amino-2-ethyl-1,3-propanediol, N-(beta-hydroxypropyl)-N'-(beta-amino-ethyl)piperazine, tris(-hydrocymethyl) amino-methane (also known as trismethylolaminomethane), 2-amino-1-butanol, ethanolamine, diethanolamine, triethanolamine, beta-(beta-hydroxyethoxy)-ethylamine and the like. Mixtures of these or similar amines can also be employed. The above description of nucleophilic reactants suitable for reaction with the hydrocarbyl substituted dicarboxylic acid or anhydride includes amines, alcohols, and compounds of mixed amine and hydroxy containing reactive functional groups, i.e. amino-alcohols.

Also useful as nitrogen containing dispersants in this invention are the adducts of group (A)(ii) above wherein a nitrogen containing polyamine is attached directly to the long chain aliphatic hydrocarbon (as shown in U.S. Pat. Nos. 3,275/554 and 3,565,804 the disclosures of which are hereby incorporated by reference in their entirety) where the halogen group on the halogenated hydrocarbon is displaced with various alkylene polyamines.

Another class of nitrogen containing dispersants in this invention are the adducts of group (A)(iii) above which contain Mannich base or Mannich condensation products as they are known in the art. Such Mannich condensation products (A)(iii) generally are prepared by condensing about 1 mole of a high molecular weight hydrocarbyl substituted hydroxy aromatic compound (e.g., having a number average molecular weight of 700 or greater) with about 1 to 2.5 moles of an aldehyde such as formaldehyde or pardformaldehyde and about 0.5 to 2 moles polyalkylene polyamine as disclosed, e.g., in U.S. Pat. Nos. 3,442,808; 3,649,229; and 3,798,165 (the disclosures which are hereby incorporated by reference in their entirety). Such Mannich condensation products (A)(iii) may include a long chain, high molecular weight hydrocarbon on the phenol group or may be reacted with a compound containing such a hydrocarbon, e.g., polyalkenyl succinic arthydride as shown in said, aforementioned U.S. Pat. No. 3,442,808.

The optionally substituted hydroxy aromatic compounds used in the preparation of the Mannich base products (A)(iii) include those compounds having the formula $$R^{21}{}_y\text{—Aryl—}(OH)_z \qquad \text{(XV)}$$

wherein Aryl represents

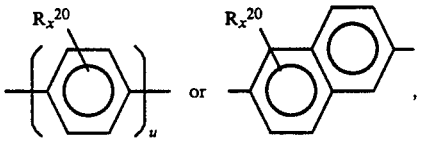

wherein u is 1 or 2, $R^{21}$ is a long chain hydrocarbon, $R^{20}$ is a hydrocarbon or substituted hydrocarbon radical having from 1 to about 3 carbon atoms or a halogen radical such as the bromide or chloride radical, y is an integer from 1 to 2, x is an integer from 0 to 2, and z is an integer from 1 to 2.

Illustrative of such Aryl groups are phenylene, biphenylene, naphthylene and the like.

The long chain hydrocarbon $R^{21}$ substituents are olefin polymers as described above for those olefin polymers useful in forming reactants (A)(i).

Processes for substituting the hydroxy aromatic compounds with the olefin polymer are known in the art and may be depicted as follows (Eq. 1):

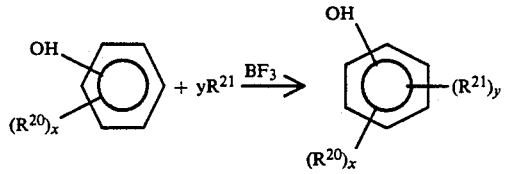

where $R^{20}$, $R^{21}$, y and x are as previously defined, and $BF_3$ is an alkylating catalyst. Processes of this type are described, for example, in U.S. Pat. No. 3,539,633 and 3,649,229, the disclosures of which are incorporated herein by reference.

Representative hydrocarbyl-substituted hydroxy aromatic compounds contemplated for use in the present invention include, but are not limited to, 2-polypropylene phenol, 3-polypropylene phenol, 4-polypropylene phenol, 2-polybutylene phenol, 3-polyisobutylene phenol, 4-polyisobutylene phenol, 4-polyisobutylene-2-chlorophenol, 4-polyisobutylene-2-methylphenol, and the like.

Suitable hydrocarbyl-substitued polyhydroxy aromatic compounds include the polyolefin catechols, the polyolefin resorcinols, and the polyolefin hydroquinones, e.g., 4-polyisobutylene-1,2-dihydroxybenzene, 3-polypropylene-1,2-dihydroxybenzene, 5-polyisobutylene-1,3-dihydroxybenzene, 4-polyamylene-1,3-dihydroxybenzene, and the like.

Suitable hydrocarbyl-substituted naphthols include 1-polyisobutylene-5-hydroxynaphthalene, 1-polypropylene-3-hydroxynaphthalene and the like.

The preferred long chain hydrocarbyl substituted hydroxy aromatic compounds to be used in forming a Mannich Base product (A)(iii) for use in this invention can be illustrated by the formula:

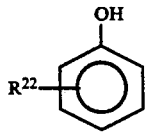

(XVI)

wherein $R^{22}$ is hydrocarbyl of from 50 to 300 carbon atoms, and preferably is a polyolefin derived from a $C_2$ to $C_{10}$ (e.g., $C_2$ to $C_5$) mono-alpha-olefin.

The aldehyde material which can be employed in the production of the Mannich base (A)(iii) and (A)(iv) is represented by the formula:

$$R^{23}CHO \qquad \text{(XVII)}$$

in which $R^{23}$ is hydrogen or an aliphatic hydrocarbon radical having from 1 to 4 carbon atoms. Examples of suitable aldehydes include formaldehyde, paraformaldehyde, acetaldehyde and the like. The polyamine materials which can be employed include those amines described above as suitable in the preparation of Reactants (A)(i).

Still another class of nitrogen containing dispersants which are useful in this invention are the adducts of group (A)(iv) above which contain Mannich base aminophenol-type condensation products as they are known in the art. Such Mannich condensation products (A)(iv) generally are prepared by reacting about 1 mole of long chain hydrocarbon substituted mono and dicarboxylic acids or their anhydrides with about 1 mole of amine-substituted hydroxy aromatic compound (e.g., aminophenol), which aromatic compound can also be halogen- or hydrocarbyl-substituted, to form a long chain hydrocarbon substituted amide or imide-containing phenol intemediate adduct (generally having a number average molecular weight of 700 or greater), and condensing about a molar proportion of the long chain hydrocarbon substituted amide- or imide-containing phenol intermediate adduct with about 1 to 2.5 moles of formaldehyde and about 0.5 to 2 moles of polyamine, e.g. polyakylene polyamine.

The optionally-hydrocarbyl substituted hydroxy aromatic compounds used in the preparation of the Mannich base products (A)(iv) include those compounds having the formula

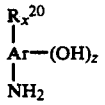

(XVIII)

wherein At, $R^{20}$, x and z are as defined above.

Preferred N-(hydroxyaryl) amine reactants to be used in forming a Mannich Base product (A)(iv) for use in this invention are amino phenols of the formula:

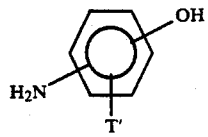

(XIX)

in which T' is hydrogen, an alkyl radical having from 1 to 3 carbon atoms, or a halogen radical such as the chloride or bromide radical.

Suitable aminophenols include 2-aminophenol, 3-aminophenol, 4-aminophenol, 4-amino-3-methylphenol, 4-amino-3-chlorophenol , 4-amino-2-bromophenol and 4-amino-3-ethylphenol.

Suitable amino-substituted polyhydroxyaryls are the aminocatechols, the amino resorcinols, and the aminohydroquinones, e.g., 4-amino-1,2-dihydroxybenzene, 3-amino-1,2-dihydroxybenzene, 5-amino-1,3-dihydroxybenzene, 4-amino-1,3-dihydroxybenzene, 2-amino-1,4-dihydroxybenzene, 3-amino-1,4-dihydroxybenzene and the like.

Suitable aminonaphthols include 1-amino-5-hydroxynaphthalene, 1-amino-3-hydroxynaphthalene and the like.

The long chain hydrocarbyl substituted mono- or dicarboxylic acid or anhydride materials useful for reaction with the amine-substituted aromatic compound to prepare the amide or imide intermediates in the formation of Reactant (A)(iv) can comprise any of those described above which are useful in preparing the reactant (A)(i). The foregoing adducts of the selected and amine-substituted aromatic compound can then be contacted with an aldehyde and amine for the Mannich Base reaction as described above. The aldehyde and amine can comprise any of those described above as being useful in formation of the Reactant (A)(iii) materials.

In one preferred aspect of this invention the dispersant adducts (A)(iv) are prepared by reacting the olefin polymer substituted mono- or dicarboxylic acid material with the N-(hydroxyaryl amine) material to form a carbonyl-amino material containing at least one group having a carbonyl group bonded to a secondary or a tertiary nitrogen atom. In the amide form, the carbonyl-amino material can contain 1 or 2—C(O)—NH— groups, and in the imide form the carbonyl-amino material will contain —C(O)—N—C(O)— groups. The carbonyl-amino material can therefore comprise N-(hydroxyaryl) polymer-substituted dicarboxylic acid diamide, N-(hydroxyaryl) polymer-substituted dicarboxylic acid imide, N-(hydroxyaryl) polymer substituted-monocarboxylic acid monoamide, N-(hydroxyaryl) polymer-substituted dicarboxylic acid monoamide or a mixture thereof.

In general, amounts of the olefin polymer substituted mono- or dicarboxylic acid material, such as olefin polymer substituted succinic anhydride, and of the N-(hydroxyaryl) amine, such as p-aminophenol, which are effective to provide about one equivalent of a dicarboxylic acid or anhydride moiety or monocarboxylic acid moiety per equivalent of amine moiety are dissolved in an inert solvent (i.e. a hydrocarbon solvent such as toluene, xylene, or isooctane) and reacted at a moderately elevated temperature up to the reflux temperature of the solvent used, for sufficient time to complete the formation of the intermediate N-(hydroxyaryl) hydrocarbyl amide or imide. When an olefin polymer substituted monocarboyxlic acid material is used, the resulting intermediate which is generally formed comprises amide groups. Similarly, when an olefin polymer substituted dicarboxylic acid material is used, the resulting intermediate generally comprises imide groups, although amide groups can also be present in a portion of the carbonyl-amino material thus formed. Thereafter, the solvent is removed under vacuum at an elevated temperature, generally, at approximately 160° C.

Alternatively, the intermediate is prepared by combining amounts of the olefin polymer substituted mono- or dicarboxylic acid material sufficient to provide about one equivalent of dicarboxylic acid or anhydride moiety or monocarboyxlic acid moiety per equivalent of amine moiety (of the N-(hydroxyaryl) amine) and the N-(hydroxyaryl) amine, and heating the resulting mixture at elevated temperature under a nitrogen purge in the absence of solvent.

The resulting N-(hydroxyaryl) polymer substituted imides can be illustrated by the succinimides of the formula (xx):

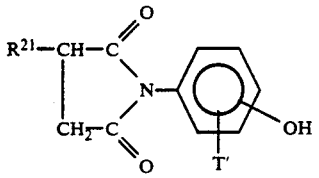

wherein T' is as defined above, and wherein $R^{21}$ is as defined above. Similarly, when the olefin polymer substituted monocarboxylic acid material is used, the resulting N-(hydroxyaryl) polymer substituted amides can be represented by the propionamides of the formula (XXI):

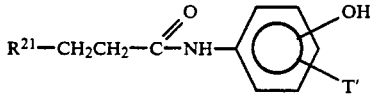

wherein T' and $R^{21}$ are as defined above.

In a second step, the carbonyl-amino intermediate is reacted with an amine compound (or mixture of amine compounds) , such as a polyfunctional amine, together with an aldehyde (e.g., formaldehyde) in the Mannich base reaction. In general, the reactants are admixed and reacted at an elevated temperature until the reaction is complete. This reaction may be conducted in the presence of a solvent and in the presence of a quantity of mineral oil which is an effective solvent for the finished Mannich base dispersant material . This second step can be illustrated by the Mannich base reaction between the above N-(hydroxyphenyl) polymer succinimide intermediate, paraformaldehyde and ethylene diamine in accordance with the following equation:

(Eq. 2)

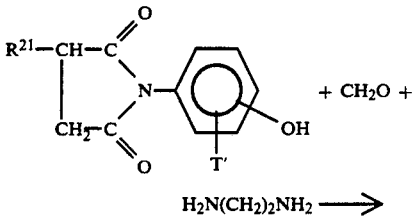

-continued

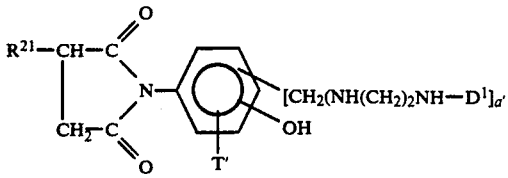

wherein a' is an integer of 1 or 2, $R^{21}$ and T' are as defined above, and $D^1$ is H or the moiety

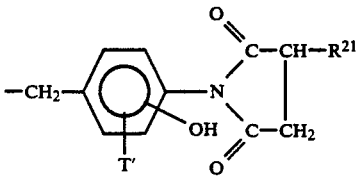

wherein $R^{21}$ and T' are as defined above. Similarly, this second step can be illustrated by the Mannich base reaction between the above N-(hydroxyphenyl) polymer acrylamide intermediate, paraformaldehyde and ethylene diamine in accordance with the following equation:

(Eq. 3)

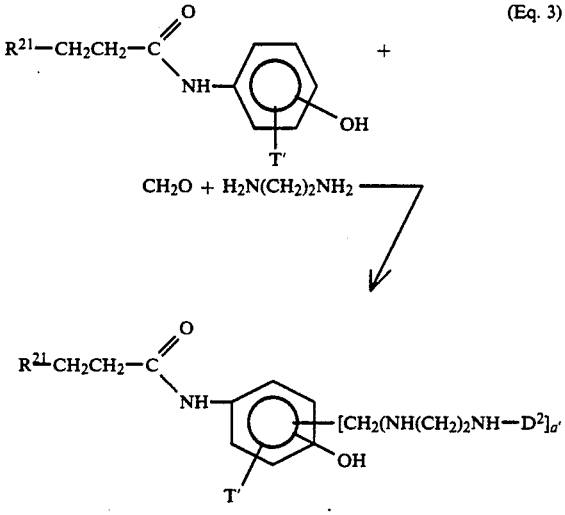

wherein a' is an integer of 1 or 2, $R^{21}$ and T' are as defined above, and $D^2$ is H or the moiety

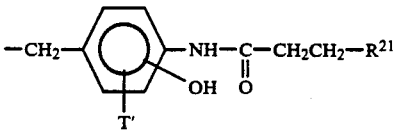

wherein $R^{21}$ and T' are as defined above.

Generally, the reaction of one mole of the carbonyl-amino material, e.g. a N-(hydroxyaryl) polymer succimide or amide intermediate, with two moles of aldehyde and one mole of amine will favor formation of the products comprising two moleties of bridged by an -alk-amine-alk-group wherein the "alk" moieties are derived from the aldehyde (e.g., $-CH_2-$ from $CH_2O$) and the "amine" moiety is a bivalent bis-N terminated amino group derived from the amine reactant (e.g., from polyalkylene polyamine). Such products are illustrated by Equations 2 and 3 above wherein a' is one, $D^1$ is the moiety

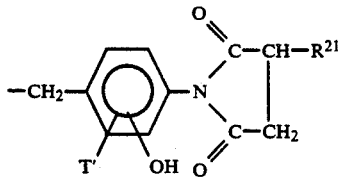

and $D^2$ is the moiety

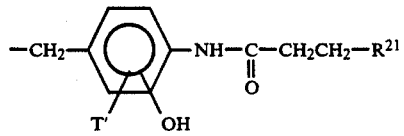

wherein T' and $R^{21}$ are as defined above.

In a similar manner, the reaction of substantially equimolar amounts of the carbonyl-amino material, aldehyde and amine reactant favors the formation of products illustrated by Equations 2 and 3 wherein "a'" is one. and $D^1$ and $D^2$ and are each H, and the reaction of one mole of carbonyl-amino material with two moles of aldehyde and two mole of the amine reactant permits the formation of increased amounts of the products illustrated by Equations 2 and 3 wherein "a'" is 2 and $D^1$ and $D^2$ are each H.

In preparing Reactants (A)(iv), the order of reacting the various reactants can be modified such that, for example, the N-hydroxyaryl amine is first admixed and reacted with the amine material and aldehyde in the Mannich base reaction to form an aminomethyl hydroxyaryl amine material. Thereafter, the resulting intermediate adduct is reacted with the olefin polymer substituted mono- or dicarboxylic acid material to form the desired dispersant. The sequence of reactions performed in accordance with this aspect of the invention tends to result in the formation of various dispersant isomers because of the plurality of aromatic materials formed in the first Mannich base condensation step and the primary and secondary nitrogen atoms which are available for reaction with the carboxy moieties of the mono- or dicarboxylic acid materials.

The Mannich base intermediate adduct (A)(iv) formed by the reaction of the N-hydroxyaryl amine with the amine reactant and formaldehyde can comprise at least one compound selected from the group consisting of:

(a) adducts of the structural formula (XXII):

$$H\text{-}(A\text{—}A')_{x1}\text{—}Ar'A'\text{—}A\text{—}(A'Ar'A'A)_{x2}\text{—}(A'Ar')_{x3}\text{—}H$$

wherein $x_1$ is 0 or 1, $x_2$ is an integer of 0 to 8, $x_3$ is 0 or 1, A is a bivalent bis-N terminated amino group derived from the amine reactant and comprises an amine group containing from 2 to 60 (preferably from 2 to 40) carbon atoms and from 1 to 12 (preferably from 3 to 13) nitrogen atoms, and A' comprises the group —CH(T'')— wherein T'' is H or alkyl of from 1 to 9 carbon atoms and is derived from the corresponding aldehyde reactant, and Ar' comprises the moiety (XXIII):

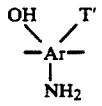

wherein T' and Ar are as defined above for the N-hydroxyaryl amines employed in this invention; and (b) adducts of the structure (XXIV):

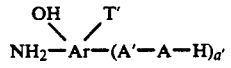

wherein a', T', A', A and Ar are as defined above Preferred adducts of formula XXII above are those wherein $x_1$ is 0, $x_2$ is 1 to 3, and $x_3$ is 1, and most preferably wherein T' is H or alkyl of 1 to 3 carbon atoms, and Ar is phenylene. Preferred adducts of formula XXIV are those wherein Ar is phenylene.

Preferably, the "A" bivalent amino group will comprise terminal —NH— groups, as exemplified by the structures of the formula (XXV):

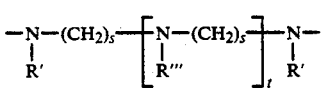

(i)

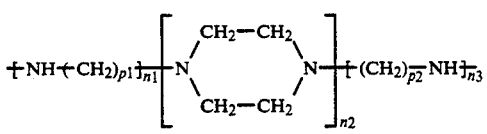

(ii)

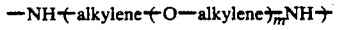

(iii)

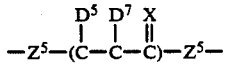

(iv)

wherein $Z^5$ comprises at least one member selected from the group consisting of (XXV) (i), (ii) and (iii) above, wherein R', R''', "t" and "s" are as defined above with respect to Formula I; $p_1$, $p_2$, $n_1$, $n_2$ and $n_3$ are as defined above with respect to Formula III; "alkylene" and "m" are as defined above with respect to Formula IV; and $D^5$, $D^7$ and X are as defined above with respect to Formula VI.

Illustrative adducts of structure XXIV are set forth in Table A below:

TABLE A

| $x_1$ | $x_2$ | $x_3$ | Ar' | A' | A |
|---|---|---|---|---|---|
| 0 | 2 | 1 | —Ph(OH)(NH$_2$)— | —CH$_2$— | —NH(Et)NH(Et)NH— |
| 0 | 2 | 1 | " | " | —NH(Et)(NH(Et))$_3$NH— |
| 0 | 1 | 0 | " | " | —NH(Et)NH(Et)NH— |
| 0 | 0 | 0 | " | " | —NH(Et)(NH(Et))$_3$NH— |
| 0 | 1 | 1 | " | " | —NH(Et)NH(Et)NH— |
| 0 | 1 | 1 | " | " | —NH(Et)(NH(Et))$_3$NH— |
| 1 | 2 | 0 | " | —CH(CH$_3$)— | —NH(Et)NH(Et)NH— |

TABLE A-continued

| $x_1$ | $x_2$ | $x_3$ | Ar' | A' | A |
|---|---|---|---|---|---|
| 1 | 0 | 1 | " | " | —NH(Et)(NH(Et))$_5$NH— |
| 1 | 3 | 0 | " | " | —NH(Et)(NH(Et))$_5$NH— |
| 1 | 1 | 0 | " | " | —NH(Et)(NH(Et))$_5$NH— |
| 1 | 1 | 1 | " | " | —NH(Et)(NH(Et))$_5$NH— |
| 0 | 2 | 1 | " | " | —NH(Et)(NH(Et))$_6$NH— |

(Ph = phenyl; Et = $C_2H_4$)

Illustrative adducts of structure XXIII are set forth below wherein Ar is tri- or tetra-substituted phenyl:

TABLE B

| a | T' | A' | A |
|---|---|---|---|
| 1 | H | —$CH_2$— | —NH(Et)NH(Et)NH— |
| 2 | $CH_3$ | " | —NH(Et)(NH(Et))$_3$NH— |
| 1 | $CH_3$ | " | —NH(Et)NH(Et)NH— |
| 2 | $C_2H_5$ | " | —NH(Et)(NH(Et))$_5$NH— |
| 1 | $C_3H_7$ | " | —NH(Et)NH(Et)NH— |
| 2 | $C_4H_9$ | " | —NH(Et)(NH(Et))$_6$NH— |
| 1 | H | —CH($CH_3$)— | —NH(Et)NH(Et)NH— |

TABLE B-continued

| a | T' | A' | A |
|---|---|---|---|
| 2 | $CH_3$ | " | —NH(Et)(NH(Et))$_5$NH— |

(Et = $C_2H_4$)

For the sake of illustration, this aspect of the invention may be represented by the following equations (wherein $R^{21}$, T' and a' are as defined above):

Dicarboxylic acid materials:

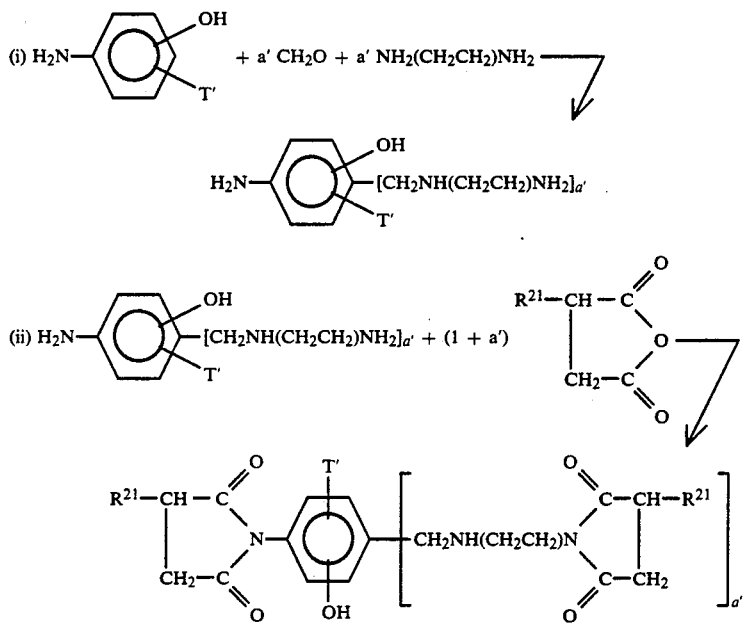

Monocarboxylic acid materials:

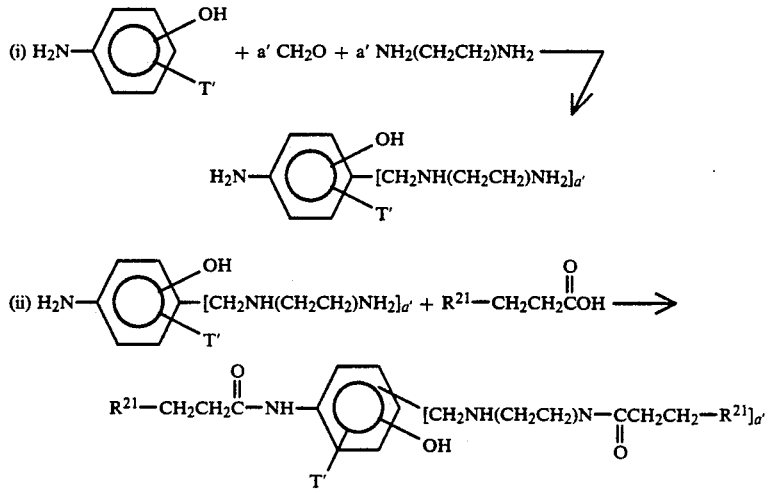

In one embodiment of the preparation of Reactants (A)(iv), a carbonyl-amino material comprising a polyisobutylene substituted hydroxyaryl succinimide, which has been prepared by first reacting a polyisobutylene succinic anhydride with an aminophenol to form an intermediate product, is reacted with formaldehyde and a mixture of poly(ethyleneamines) in the Mannich base reaction as outlined above to form the Reactant (A)(iv) adducts. In another embodiment, an aminophenol is first reacted with formaldehyde and a mixture of poly (ethyleneamines) in the Mannich base reaction as outlined above to form an intermediate material containing from one to three (polyamino) methyl-substituted aminohydroxy aryl groups per molecule, followed by reacting this intermediate with a polyisobutylene succinic anhydride to form the Mannich Base (A)(iv) adducts. A preferred group of Mannich Base (A)(iv) adducts are those formed by condensing polymer with formaldehyde and polyethylene amines, e.g., tetraethylene pentamine, pentaethylene hexamine, polyoxyethylene and polyoxypropylene amines, e.g., polyoxypropylene diamine, and combinations thereof. One particularly preferred dispersant combination involves a condensation of (a″) polymer substituted succinic anhydride or propionic acid, (b″) aminophenol, (c″) formaldehyde, and (d″) at least one of ($d''_1$) a polyoxyalkylene polyamine, e.g., polyoxypropylene diamine, and ($d''_2$) a polyalkylene polyamine, e.g. polyethylene diamine and tetraethylene pentamine, using a a″:b″:c″:d molar ratio of 1:1–8:1:0.1–10, and preferably 1:2–6:1:1–4, wherein the a″:($d''_1$):($d''_2$) molar ratio is 1:0–5:0–5, and preferably 1:0–4:1–4.

Most preferably, when the aldehyde comprises formaldehyde (or a material which generates formaldehyde in situ), and the amine comprises a di-primary amine (e.g., polyalkylene polyamine), the formaldehyde and di-primary amine are employed in an amount of about 2(q-1) moles of formaldehyde and about (q-1) moles of diprimary amine per "q" molar equivalents charged of the hydroxy-aryl group.

The nitrogen containing dispersants can be further treated by boration as generally taught in U.S. Pat. Nos. 3,087,936 and 3,254,025 (incorporated herein by reference thereto). This is readily accomplished by treating the selected acyl nitrogen dispersant with a boron compound selected from the class consisting of boron oxide, boron halides, boron acids and esters of boron acids in an amount to provide from about 0.1 atomic proportion of boron for each mole of said acylated nitrogen composition to about 20 atomic proportions of boron for each atomic proportion of nitrogen of said acylated nitrogen composition. Usefully the dispersants of the inventive combination contain from about 0.05 to 2.0 wt. %, e.g. 0.05 to 0.7 wt. % boron based on the total weight of said borated acyl nitrogen compound. The boron, which appears to be in the product as dehydrated boric acid polymers (primarily $(HBO_2)_3$), is believed to attach to the dispersant imides and diimides as amine salts, e.g., the metaborate salt of said diimide.

Treating is readily carried out by adding from about 0.05 to 4, e.g. 1 to 3 wt. % (based on the weight of said acyl nitrogen compound) of said boron compound, preferably boric acid which is most usually added as a slurry to said acyl nitrogen compound and heating with stirring at from about 135° C. to 190, e.g. 140°–170° C., for from 1 to 5 hours followed by nitrogen stripping at said temperature ranges. Or, the boron treatment can be carried out by adding boric acid to the hot reaction mixture of the dicarboxylic acid material and amine while removing water.

In a preferred embodiment of the instant invention the dispersants employed in this invention are the nitrogen containing adducts of group (A)(i) above, i.e., those derived from a hydrocarbyl substituted mono- or dicarboxylic acid forming material (acids or anhydrides) and reacted with polyamines. Particularly preferred adducts of this type are those derived from polyisobutylene substituted with succinic anhydride or propionic acid groups and reacted with polyethylene amines, e.g. tetraethylene pentamine , pentaethylene hexamine, polyoxyethylene and polyoxypropylene amines, e.g. polyoxypropylene diamine, trismethylolaminoethane and combinations thereof.

Another preferred group of ashless dispersants useful as Component A in this invention are dispersant additive mixtures comprising (a) a first dispersant comprising a reaction product of a polyolefin of 1,500 to 5,000 number average molecular weight substituted with 1.05 to 1.25, preferably 1.06 to 1.20, e.g., 1.10 to 1.20 dicarboxylic acid producing moieties (preferably acid or anhydride moleties) per polyolefin molecule, with a first nucleophilic reactant comprising any of the above-described amines, alcohols, amino-alcohols and mixtures thereof; and (b) a second dispersant comprising a reaction product of a second polyolefin of 700 to 1150 number average molecular weight substituted with 1.2 to 2.0, preferably 1.3 to 1.8, e.g., 1.4 to 1.7, dicarboxylic acid producing moieties (preferably acid or anhydride moleties) per polyolefin molecule, with a second nucleophilic reactant comprising any of the above-described amines, alcohols, amino-alcohols and mixtures thereof, wherein the weight ratio of a: b is from about 0.1:1 to 10:1. These dispersant mixtures will generally comprise from about 10 to 90 wt. % of dispersant (a) and from about 90 to 10 wt. % of dispersant (b), preferably from about 15 to 70 wt. % of dispersant (a) and about 85 to 30 wt. % of dispersant (b), and more preferably from about 40 to 80 wt. % of dispersant (a), and about 20 to 60 wt. % of dispersant (b), calculated as the respective active ingredients (e.g., exclusive of diluent oil, solvent or unreacted polyalkene). Preferably, the weight:weight ratios of dispersant (a) to dispersant (b) will be in the range of from about 0.2:1 to 2.3:1 and, more preferably from about 0.25:1 to 1.5:1.

These dispersant additive mixtures provide enhanced diesel performance and to exhibit superior viscometric properties by controlling the degree of functionality and molecular weight of two, individually prepared dispersant components. In these dispersant mixtures, the high degree of functionality is localized in the low molecular weight dispersant components, and the low degree of functionality is localized in the high molecular weight components, rather than being randomly distributed throughout the dispersant molecules. The dispersant mixtures are described in co-pending Ser. No. 95,056, filed Sep. 9, 1987, the disclosure of which is incorporated herein in its entirety.

Component B

Useful antioxidant materials include oil soluble phenolic compounds, oil soluble sulfurized organic compounds, oil soluble amine antioxidants, oil soluble organo borates, oil soluble organo phosphites, oil soluble organo phosphates, oil soluble organo dithiophosphates and mixtures thereof. Preferably such antioxidants are metal-free (that is, free of metals which are capable of generating sulfated ash), and therefore are most preferably ashless (having a sulfated ash value of not greater than wt. % SASH, as determined by ASTM D874).

Illustrative of oil soluble phenolic compounds are alkylated monophenols, alkylated hydroquinones, hydroxylated thiodiphenyl ethers, alkylidenebisphenols, benzyl compounds, acylaminophenols, and esters and amides of hindered phenol-substituted alkanoic acids.

EXAMPLES OF PHENOLIC ANTIOXIDANTS

1. Alkylated monophenols 2,6-di-tert-butyl-4-methylphenol; 2,6-di-tert-butylphenol; 2-tert-butyl-4,6-dimethylphenol; 2,6-di-tertbutyl-4-ethylphenol; 2,6-di-tert-butyl-4-ethylphenol; 2,6-di-tert-butyl-4-n-butylphenol; 2,6-di-tertbutyl-4-isobutylphenol; 2,6-dicyclopentyl-4-methylphenol; 2-(α-methylcyclohexyl)-4,6-dimethylphenol; 2,6-dioctadecyl-4-methylphenol; 2,4,6-tricyclohexylphenol; 2,6-di-tert-butyl-4-methoxymethylphenol o-tert-butylphenol.

2. Alkylated hydroquinones 2,6-di-tert-butyl-4-methoxyphenol; 2,5-di-tertbutylhydroquinone; 2,5-di-tert-amylhydroquinone; 2,6-diphenyl-4-octadecyloxyphenol.

3. Hydroxylated thiodiphenyl ethers 2,2'-thiohis (6-tert-butyl-4-methylphenol); 2,2'-thiobis(4-octylphenol); 4,4,-thiobis(6-tert-butyl-3-methylphenol ); 4,4'-thiobis (6-tert-butyl-2-methylphenol).

4. Alkylidenebisphenols 2,2'-methylenebis (6-tert-butyl-4-methylphenol); 2,2'-methylenebis (6-tert-butyl-4-ethylphenol); 2,2'-methylenebis [4-methyl-6-(α-methylcyclohexyl) -phenol]; 2,2'-methylenebis (4-methyl-6-cyclohexylphenol); 2,2'-methylenebis (6-nonyl-4-methylphenol); 2,2'-methylenebis (4,6-di-tert-butylphenol); 2,2'-ethylidenebis (4,6-di-tert-butylphenol); 2,2'-ethylidenebis (6-tert-butyl-4-isobutylphenol); 2,2'-methylenebis [6-(α-methylbenzyl)-4-nonylphenol]; 2,2'-methylenebis [6- (2, α-dimethylbenzyl)-4-nonyl-phenol]; 4,4'-methylenebis (2,6-di-tert-butylphenol); 4,4'-methylenebis (6-tert-butyl-2-methylphenol); 1,1-bis (5-tert-butyl-4-hydroxy-2-methylphenyl) butane; 2,6-di (3-tert-butyl-5-methyl-2-hydroxybenzyl) -4-methylphenol; 1,1,3-tris (5-tert-butyl-4-hydroxy-2-methylphenyl)-3-n-dodecylmercapobutane; ethylene glycol bis [3,3-bis (3'-tert-butyl-4'-hydroxylphenyl) butyrate]; di(3-tert-butyl-4-hydroxy-5-methylphenyl) dicyclopentadiene; di[2-(3'-tert-butyl-2'-hydroxy-5'-methylbenzyl)-6-tertbutyl -4-methyl pheny] terephthalate.

5. Benzyl compounds 1,3,5-tris (3,5-di-tert-butyl-4-hydroxybenzyl)-2,4,6-trimethylbenzene; di(3,5-di-tert-butyl-4-hydroxybenzyl) sulfide; 3,5-di-tert-butyl-4-hydroxybenzylmercaptoacetic acid isooctyl ester; bis(4-tert-butyl-3-hydroxy-2,6-dimethylbenzyl) dithioterephthalate; 1,3,5-tris (3,5-di-tertbutyl-4-hydroxybenzyl)isocyanurate; 1,3,5-tris(4-tertbutyl-3-hydroxy-2,6-dimethylbenzyl) isocyanurate; 3,5-di-tert-butyl-4-hydroxybenzylphosphonic acid dioctadecyl ester 3,5-di-tert-butyl-4-hydroxybenzylphosphonic acid monoethyl ester calcium salt.

6. Acylaminophenols 4-hydroxylauric acid anilide; 4-hydroxystearic acid anilide; 2,4-bis-octylmercapto-6-(3,5-di-tert-butyl-4-hydroxyanilino)-s-triazine; N-(3,5-di-tert-butyl-4-hydroxyphenyl)carbamic acid octyl ester.

7. Esters of β-(3,5-di-tert-butyl-4-hydroxyphenyl)-propionic acid with mono- or polyhydric alcohols, e.g. with methanol; octadecanol; 1,6-hexanediol; neopentyl glycol; thiodiethylene glycol; diethylene glycol; triethylene glycol; pentaerythritol; tris(hydroxyethyl-)isocyanurate; and di(hydroxyethyl)oxalic acid diamide.

8. Esters of β-(5-tert-butyl-4-hydroxy-3-methylphenyl) propionic acid with mono- or polyhydric alcohols, e.g. with methanol; octadecanol; 1,6-hexanediol; neopentyl glycol; thiodiethylene glycol; diethylene glycol; triethylene glycol; pentaerythritol; tris (hydroxyethyl-)isocyanurate; and di(hydroyethyl)oxalic acid diamide.

9. Amides of β-(3,5-di-tert-butyl-4-hydroxyphenyl)-propionic acid, e.g. , N,N'-di(3,5-di-tert-butyl-4 -hydroxyhenylproprionyl) hexamethylenediamine; N,N'-di (3,5-di-tert-butyl-4-hydroxyphenylpropionyl)trimethylenediamine; N,N'-di(3,5-di-tert-butyl4-hydroxyphenylpropionyl) hydrazine.

A wide variety of sulfurized organic compounds can be utilized as component (B) in the compositions of the present invention and these compounds may generally be represented by the formula (XXVI):

$$R^{30}S_{x4}R^{31}$$

wherein S represents sulfur, $x_4$ is a whole number having a value of from 1 to about 10, and $R^{30}$ and $R^{31}$ may be the same or different organic groups. The organic groups may be hydrocarbon groups or substituted hydrocarbon groups containing alkyl, aryl, aralkyl, alkaryl, alkanoate, thiazole, imidazole, phosphorothionate, beta-ketoalkyl groups, etc. The substantially hydrocarbon groups may contain other substituents such as halogen, amino, hydroxyl, mercapto, alkoxy, aryloxy, thio, nitro, sulfonic acid, carboxylic acid, carboxylic acid ester, etc.

Specific examples of types of sulfurized compositions which are useful as component (B) in the compositions of this invention include aromatic, alkyl or alkenyl sulfides and polysulfides, sulfurized olefins, sulfurized carboxylic acid esters, sulfurized ester olefins, sulfurized oil, and mixtures thereof. The preparation of such oil-soluble sulfurized compositions is described in the art, and U.S. Pat. No. 4,612,129 is incorporated herein by reference in its entirety for its disclosure of such preparations; including the type and amount of reactants and catalysts (or promoters), temperatures and other process conditions, and product purification and recovery techniques (e.g., decoloring, filtering, and other solids and impurity removal steps).

The sulfurized organic compounds utilized in the present invention may be aromatic and alkyl sulfides such as dibenzyl sulfide, dixylyl sulfide, dicetyl sulfide, diparaffin wax sulfide and polysulfide, cracked wax oleum sulfides, etc.

Examples of dialkenyl sulfides which are useful in the compositions of the present invention are described in U.S. Pat. No. 2,446,072. Examples of sulfides of this type include 6,6'-dithiobis (5-methyl-4-nonene), 2-butenyl monosulfide and disulfide, and 2-methyl-2-butenyl monosulfide and disulfide.

The sulfurized olefins which are useful as component (B) in the compositions of the present invention include sulfurized olefins prepared by the reaction of an olefin (preferably containing 3 to 6 carbon atoms) or a lower molecular weight polyolefin derived therefrom, with a sulfur-containing compound such as sulfur, sulfur monochloride and/or sulfur dichloride, hydrogen sulfide, etc. Isobutene, propylene and their dimers, trimers and tetramers, and mixtures thereof are especially preferred olefinic compounds. Of these compounds, isobutylene and diisobutylene are particularly desirable because of their availability and the particularly high sulfur-containing compositions which can be prepared therefrom.

The sulfurized organic compounds utilized in the compositions of the present invention may be sulfurized oils which may be prepared by treating natural or synthetic oils including mineral oils, lard oil, carboxylic acid esters derived from aliphatic alcohols and fatty acids or aliphatic carboxylic acids (e.g., myristyl oleate and oleyl oleate) sperm whale oil and synthetic sperm whale oil substitutes and synthetic unsaturated esters or glycerides.

The sulfurized fatty acid esters which are useful in the compositions of this invention can be prepared by reacting sulfur, sulfur monochloride, and/or sulfur dichloride with an unsaturated fatty ester at elevated temperatures. Typical esters include $C_1$–$C_{20}$ alkyl esters of $C_8$–$C_{24}$ unsaturated fatty acids such as palmitoleic oleic, ricinoleic, petroselic, vaccenic, linoleic, linolenic, oleostearic; licanic, etc. Sulfurized fatty acid esters prepared from mixed unsaturated fatty acid esters such as are obtained from animal fats and vegetable oils such as tall oil, linseed oil, olive oil, castor oil, peanut oil, rape oil, fish oil, sperm oil, etc. also are useful. Specific examples of the fatty esters which can be sulfurized include lauryl talate, methyl oleate, ethyl oleate, lauryl oleate, cetyl oleate, cetyl linoleate, lauryl ricinoleate, oleolinoleate, oleostearate, and alkyl glycerides.

Another class of organic sulfur-containing compounds which can be used as component (B) in the compositions of the present invention includes sulfurized aliphatic esters of an olefinic monodicarboxylic acid. For example, aliphatic alcohols of from 1 to 30 carbon atoms can be used to esterify monocarboxylic acids such as acrylic acid, methacrylic acid, 2,4-pentadienic acid, etc. or fumaric acid, maleic acid, muconic acid, etc. Sulfurization of these esters is conducted with elemental sulfur, sulfur monochloride and/or sulfur dichloride.

Another class of sulfurized organic compounds can be utilized in the compositions of the invention are diestersulfides characterized by the following general formula (XXVII):

$$-S_{x6}[(CH_2)_{x5}COOR^{32}]_2$$

wherein $x_5$ is from about 2 to about 5; $x_6$ is from 1 to about 6; preferably 1 to about 3; and $R^{32}$ is an alkyl group having from about 4 to about 20 carbon atoms. The $R^{32}$ group may be a straight chain or branched chain group that is large enough to maintain the solubility of the compositions of the invention on oil. Typical diesters include the butyl, amyl, hexyl, heptyl, octyl, nonyl, decyl, tridecyl, myristyl, pentadecyl, cetyl, heptadecyl, stearyl, lauryl, and eicosyl diesters of thiodialkanoic acids such as propionic, butanoic, pentanoic and hexanoic acids. Of the diester sulfides, a specific example is dilauryl, 3,3'-thiodipropionate.

In another preferred embodiment, the sulfurized organic compound (component (B)) is derived from a particular type of cyclic or bicyclic olefin which is a Diels-Alder adduct of at least one dienophile with at least one aliphatic conjugated diene. The sulfurized Dieis-Alder adducts can be prepared by reacting various sulfurizing agents with the Dieis-Alder adducts as described more fully below. Preferably, the sulfurizing agent is sulfur.

The Dieis-Alder adducts are a well-known, art-recognized class of compounds prepared by the diene synthesis of Dieis-Alder reaction. A summary of the prior art relating to this class of compounds is found in the Russian monograph, "Dienovyi Sintes", Izdatelstwo Akademii Nauk SSSR, 1963 by A. S. Onischenko. (Translated into the English language by L. Mandel as A. S. Onischenko, "Diene Synthesis", N.Y., Daniel Davey and Co., Inc., 1964.) This monograph and references cited therein are incorporated by reference into the present specification.

The sulfurized composition used in the present invention (component (B) may be at least one sulfurized terpene compound or a composition prepared by sulfurizing a mixture comprising at least one terpene and at least one other olefinic compound.

The term "terpene compound" as used in the specification and claims is intended to include the various isomeric terpene hydrocarbons having the empirical formula $C_{10}H_{16}$, such as contained in turpentine, pine oil and dipentenes, and the various synthetic and naturally occurring oxygen-containing derivatives. Mixtures of these various compounds generally will be utilized, especially when natural products such as pine oil and turpentine are used. Pine oil, for example, which is obtained by destructive distillation of waste pine wood with super-heated steam comprises a mixture of terpene derivatives such as alpha-terpineol, beta-terpineol, alpha-fenchol, camphor, borneol/isoborneol, fenchone, estragole, dihydro alpha-terpineol, anethole, and other mono-terpene hydrocarbons. The specific ratios and amounts of the various components in a given pine oil will depend upon the particular source and the degree of purification. A group of pine oil-derived products are available commercially from Hercules Incorporated. It has been found that the pine oil products generally known as terpene alcohols available from Hercules Incorporated are particularly useful in the preparation of the sulfurized products used in the invention. Examples of such products include alpha-Terpineol containing about 95–97% of alpha-terpineol, a high purity tertiary terpene alcohol mixture typically containing 96.3% of tertiary alcohols; Terpineol 318 Prime which is a mixture of isomeric terpineols obtained by dehydration of terpene hydrate and contains about 60–65 weight percent of alpha-terpineol and 15–20% beta-terpineol, and 18–20% of other tertiary terpene alcohols. Other mixtures and grades of useful pine oil products also are available from Hercules under such designations as Yarmor 302, Herco pine oil, Yarmor 302W, Yarmor F and Yarmor 60.

The terpene compounds which can be utilized in the compositions of the present invention may be sulfurized terpene compounds, sulfurized mixtures of terpene compounds or mixtures of at least one terpene compound and at least one sulfurized terpene compound. Sulfurized terpene compounds can be prepared by sulfurizing terpene compounds with sulfur, sulfur halides, or mixtures of sulfur or sulfur dioxide with hydrogen sulfide as will be described more fully hereinafter. Also, the sulfurization of various terpene compounds has been described in the prior art. For example, the sulfurization of pine oil is described in U.S. Pat. No. 2,012,446.

The other olefinic compound which may be combined with the terpene compound may be any of several olefinio compounds such as those described earlier.

The other olefin used in combination with the terpene also may be an unsaturated fatty acid, an unsaturated fatty acid ester, mixtures thereof, or mixtures thereof with the olefins described above. The term "fatty acid" as used herein refers to acids which may be obtained by hydrolysis of naturally occurring vegetable or animal fats or oils. These fatty acids usually contain from 16 to 20 carbon atoms and are mixtures of saturated and unsaturated fatty acids. The unsaturated fatty acids generally contained in the naturally occurring vegetable or animal fats and oils may contain one or more double bonds and such acids include palmitoleic acid, oleic acid, linoleic acid, linolenic acid, and erucic acid.

The unsaturated fatty acids may comprise mixtures of acids such as those obtained from naturally occurring animal and vegetable oils such as lard oil, tall oil, peanut oil, soybean oil, cottonseed oil, sunflower seed oil, or what germ oil. Tall oil is a mixture of rosin acids, mainly abietic acid, and unsaturated fatty acids, mainly oleic and linoleic acids. Tall oil is a by-product of the sulfate process for the manufacture of wood pulp.

The most particularly preferred unsaturated fatty acid esters are the fatty oils, that is, naturally occurring esters of glycerol with the fatty acids described above, and synthetic esters of similar structure. Examples of naturally occurring fats and oils containing unsaturation include animal fats such as Neat's-foot oil, lard oil, depot fat, beef tallow, etc. Examples of naturally occurring vegetable oils include cottonseed oil, corn oil, poppy-seed oil, safflower oil, sesame oil, soybean oil, sunflower seed oil and wheat germ oil.

The fatty acid esters which are useful also may be prepared from aliphatic olefinic acids of the type described above such as oleic acid, linoleic acid, linolenic acid, and behenic acid by reaction with alcohols and polyols. Examples of aliphatic alcohols which may be reacted with the above-identified acids include monohydric alcohols such as methanol, ethanol, n-propanol, isopropanol, the butanols, etc.; and polyhydric alcohols including ethylene glycol, propylene glycol, trimethylene glycol, neopentyl glycol, glycerol, etc.

The other olefinic compound utilized with the terpene compound in the preparation of the compositions of the invention includes sulfurized derivatives of said olefinic compounds. Thus, the olefin may be any one or more of the above-identified olefinic compound, their sulfurized derivatives, or mixtures of said olefinic compounds and sulfurized derivatives. The sulfurized derivatives can be prepared by methods known in the art utilizing sulfurizing reagents such as sul fur, sul fur halides or mixtures of sulfur or sulfur dioxide with hydrogen sulfide.

Exemplary of amine antioxidants useful as Component (B) are phenyl-substituted and phenylene-substituted amines, N-nitro phenyl hydroxylamine, isoindoline compounds, phosphinodithioic acid-vinyl carboxylate adducts, phosphorodithioate ester-aldehyde reaction products, phosphorodithioate-alkylene oxide reaction products silyl esters of terephthalic acid, bis-1,3-alkylamino-2-propanol, anthranilamide compounds, anthranilic acid esters, alpha-methyl styrenated aromatic amines, aromatic amines and substituted benzophenones, aminoguanidines, peroxide-treated phenothiazine, N-substituted phenothiazines and triazines, 3-tertiary alkyl-substituted phenothiazines, alkylated diphenylamines, 4-alkylphenyl-1-alkyl-2-naphthylamines, dibenzazepine compounds, fluorinated aromatic amines, alkylated polyhydroxy benzenoid compounds, substituted indans, dimethyl octadecylphosphonate-arylimino dialkanol copolymers and substituted benzodiazoborole.

EXAMPLES OF AMINE ANTIOXIDANTS

N,N'-diisopropyl-p-phenylenediamine; N,N'-di-sec-butyl-p-phenylenediame; N,N'-bis (1,4-dimethylpentyl)-p-phenylenediame; N,N'-bis (1-ethyl-3 -methylpentyl)-p-phenylenediamine; N,N'-bis (1-methylheptyl)-p-phenylenediamine; N,N'-diphenyl-p-phenylenediamine; N,N'-di (naphthyl-2)-p-phenylenediamine; N-isopropyl-N'-phenyl-p-phenylenediamine; N-(1,3-dimethylbutyl)-N'-phenyl-n-phenylenediamine; N-(1-methylheptyl)-N'-phenyl-p-phenylenediamine; N-cyclohexyl-N'-phenyl-p-phenylenediamine; 4-(p-toluenesul fonamido) dip henylamine; N,N'-dimethyl-N,N'-di-sec-butyl-p-phenylenediamine diphenylamine; 4-isopropoxy diphenylamine; N-phenyl-1-naphthylamine; N-phenyl-2-naphthylamine; octylated diphenylamine; 4-n-butylaminophenol; 4-butyrylaminophenol 4-nonanoylaminophenol; 4-dodecanoylaminophenol; 4-octadecanoylaminophenol; di- (4-methoxyphenyl amine; 2,6-di-tert-butyl-4-dimethylaminomethylphenol; 2,4'-diaminodiphenylmethane; 4,4'-diaminophenylmethane; N,N,N', N'-tetramethyl-4,4'-diaminodiphenylmethane; 1,2-di [(2-methylphenyl) amineo] ethane; 1,2-di(phenylamino)propane; (o-tolyl)biguanide; di[4-(1,3'-dimethylbutyl)phenyl]amine; tert-octylated N-phenyl-1-napthylamino; and mixture of mono- and dialkylated tert-butyl-/tert-octyldiphenylamines.

Oil soluble organo-borates, phosphates and phosphites include alkyl-and aryl (and mixed alkyl, aryl) substituted borates, alkyl- and aryl- (and mixed alkyl, aryl) substituted phosphates, alkyl- and aryl- (and mixed alkyl, aryl) substituted phosphites, and alkyl- and aryl- (and mixed alkyl, aryl) substituted dithiophosphates such as O,O,S-trialkyl dithiophosphates, O,O,S-triaryl dithiophosphates and dithiophosphates having mixed substitution by alkyl and aryl groups, phosphorothionyl sulfide, phosphorus-containing silane, polyphenylene sulfide, amine salts of phosphinic acid and quinone phosphates.

Preferred as Component (B) in the compositions of this invention is at least one sulfurized alkyl-substituted hydroxyaromatic compound as oxidation inhibitor. Sulfurized alkyl-substituted hydroxyaromatic compounds and the methods of preparing them are known in the art and are disclosed, for example,. in the following U.S. Pat. Nos. (which are incorporated by reference herein): 2,139,766; 2,198,828; 2,230,542; 2,836,565; 3,285,854; 3,538,166; 3,844,956; 3,951,830; and 4,115,287.

In general, the sulfurized alkyl-substituted hydroxyaromatic compounds may be prepared by reacting an alkyl-substituted hydroxyaromatic compound with a sulfurizing agent such as elemental sulfur, a sulfur halide (e.g., sulfur monochloride or sulfur dichloride), a mixture of hydrogen sulfide and sulfur-dioxide, or the like. The preferred sulfurizing agents are sulfur and the sulfur halides, and especially the sulfur chlorides, with sulfur dichloride ($SCl_2$) being especially preferred.

The alkyl-substituted hydroxyaromatic compounds which are sulfurized to produce Component (B) are generally compounds containing at least one hydroxy group (e.g., from 1 to 3 hydroxy groups) and at i east one alkyl radical (e.g., from 1 to 3 alkyl radicals) attached to the same aromatic ring. The alkyl radical ordinarily contains about 3–100 and preferably about 6–20 carbon atoms. The alkyl-substituted hydroxyaromatic compound may contain more than one hydroxy group as exemplified by alkyl resorcinols, hydroquinones and catechols, or it may contain more than one alkyl radical; but normally it contains only one of each. Compounds in which the alkyl and hydroxy groups are ortho, meta and para to each other, and mixtures of such compounds, are within the scope of the invention. Illustrative alkyl-substituted hydroxyaromatic compounds are n-propylphenol, isopropylphenol, n-butylphenol, t-butylphenol, hexylphenol, heptylphenol, octylphenol, nonylphenol, n-dodecylphenol, (propene tetramer)-substituted phenol, octadecylphenol, eicosylphenol, polybutene (molecular weight about 1000) -substituted phenol, n-dodecylresorcinol and 2,4-di-t-butylphenol, and the alkyl-substituted catechols corresponding to the foregoing. Also included are methylene-bridged alkyl-substituted hydroxyaromatic compounds of the type which may be prepared by the reaction of an alkyl-substituted hydroxyaromatic compound with formaldehyde or a formaldehyde-yielding reagent such as trioxane or paraformaldehyde.

The sulfurized alkyl-substituted hydroxyaromatic compound is typically prepared by reacting the alkyl-substituted hydroxyaromatic compound with the sulfurizing agent at a temperature within the range of about 100°-250° C. The reaction may take place in a substantially inert diluent such as toluene, xylene, petroleum naphtha, mineral oil, Cellosolve or the like. If the sulfurizing agent is a sulfur halide, and especially if no diluent is used, it is frequently preferred to remove acidic materials such as hydrogen halides by vacuum stripping the reaction mixture or blowing it with an inert gas such as nitrogen. If the sulfurizing agent is sulfur, it is frequently advantageous to blow the sulfurized product with an inert gas such as nitrogen or air so as to remove sulfur oxides and the like.

Also useful herein as Component (B) are antioxidants disclosed in the following U.S. Patents, the disclosures of which are herein incorporated by reference in their entirety: U.S. Pat. Nos. 3,451,166; 3,458,495; 3,470,099; 3,511,780; 3,687,848; 3,770,854; 3,850,822; 3,876,733; 3,929,654; 4,115,287; 4,136,041; 4,153,562; 4,367,152; and 4,737,301.

Component C

Component (C) of the compositions of this invention is an anti-wear agent comprising at least one dihydrocarbyl dithiophosphate, wherein the hydrocarbyl groups contain an average of at least 3 carbon atoms. Particularly useful are metal salts of at least one dihydrocarbyl dithiophosphoric acid wherein the hydrocarbyl groups contain an average of at least 3 carbon atoms.

The acids from which the dihydrocarbyl dithiophosphates can be derived can be illustrated by acids of the formula (XXVIII):

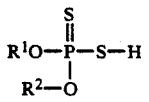

wherein $R^1$ and $R^2$ are the same or different and are alkyl, cycloalkyl, aralkyl, alkaryl or substituted substantially hydrocarbon radical derivatives of any of the above groups, and where in the $R^1$ and $R^2$ groups in the acid each have, on average, at least 3 carbon atoms.

By "substantially hydrocarbon" is meant radicals containing substituent groups (e.g., 1 to 4 substituent groups per radical moiety) such as ether, ester, nitro or halogen which do not materially affect the hydrocarbon character of the radical.

Specific examples of suitable $R^1$ and $R^2$radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl, o,p-depentylphenyl, octylphenyl, polyisobutene-(molecular weight 350) -substituted phenyl, tetrapropylene-substituted phenyl, beta-octylbutylnaphthyl, cyclopentyl, cyclohexyl, phenyl, chlorophenyl, o-dichlorophenyl, bromophenyl, naphthenyl, 2 -methylcyclohexyl, benzyl, chlorobenzyl, chloropentyl, dichlorophenyl, nitrophenyl, dichlorodecyl and xenyl radicals. Alkyl radicals having about 3-30 carbon atoms, and aryl radicals having about 6-30 carbon atoms, are preferred. Particularly preferred $R^1$ and $R^2$ radicals are alkyl of 4 to 18 carbons.

The phosphorodithioic acids are readily obtainable by the reaction of phosphorus pentasulfide and an alcohol or phenol. The reaction involves mixing, at a temperature of about 20°-200° C., 4 moles of the alcohol or phenol with one mole of phosphorus pentasulfide. Hydrogen sulfide is liberated as the reaction takes place. Mixtures of alcohols, phenols or both can be employed, e.g. mixtures of $C_3$ to $C_{30}$ alkanols, $C_6$ to $C_{30}$ aromatic alcohols, etc.

The metal salts which are useful in this invention include those salts containing Group I metals, Group II metals, aluminum, lead, tin, molybdenum, manganese, cobalt and nickel. Zinc is the preferred metal. Examples of metal compounds which may be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide and nickel carbonate.

In some instances, the incorporation of certain ingredients, particularly carboxylic acids or metal carboxylates such as small amounts of the metal acetate or acetic acid used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art and is described in a large number of issued patents, including U.S. Pat. Nos. 3,293,181; 3,397,145; 3,396,109; and 3,442,804, the disclosures of which are hereby incorporated by reference insofar as the preparation of metal salts of organic phosphorodithioic acids useful in this invention are described.

Also useful as Component (C) are amine derivatives of dithiophosphoric acid compounds, such as are described in U.S. Pat. No. 3,637,499, the disclosure of which is hereby incorporated by reference in its entirety.

LUBRICATING COMPOSITIONS

Lubricating oil compositions, e.g. automatic transmission fluids, heavy duty oils suitable for diesel engines (that is, compression ignition engines), etc., can be prepared with the additives of the invention. Universal type crankcase oils wherein the same lubricating oil compositions can be used for both gasoline and diesel engine can also be prepared. These lubricating oil formulations conventionally contain several different types of additives that will supply the characteristics that are required in the formulations. Among these types of additives are included viscosity index improvers, antioxidants, corrosion inhibitors, detergents, pour point depressants, other antiwear agents, etc., provided the fully formulated oil satisfies the low total SASH requirements of this invention.

In the preparation of heavy duty diesel lubricating oil formulations it is common practice to introduce the additives in the form of 10 to 80 wt. %, e.g. 20 to 80 wt. % active ingredient concentrates in hydrocarbon oil, e.g. mineral lubricating oil, or other suitable solvent. Usually these concentrates may be diluted with 3 to 100, e.g. 5 to 40 parts by weight of lubricating oil, per part by weight of the additive package, in forming finished lubricants, e.g. crankcase motor oils. The purpose of concentrates, of course, is to make the handling of the various materials less difficult and awkward as well as to facilitate solution or dispersion in the final blend. Thus, a Component A ashless dispersant would be usually employed in the form of a 40 to 50 wt. % concentrate, for example, in a lubricating oil fraction.

Components A, B and C of the present invention will be generally used in admixture with a lube oil basestock, comprising an oil of lubricating viscosity, including natural and synthetic lubricating oils and mixtures thereof.

Components A, B and C can be incorporated into a lubricating oil in any convenient way. Thus, these mixtures can be added directly to the oil by dispersing or dissolving the same in the oil at the desired level of concentrations of the detergent inhibitor and antiwear agent, respectively. Such blending into the additional lube oil can occur at room temperature or elevated temperatures. Alternatively, the Components A, B and C can be blended with a suitable oil-soluble solvent and base oil to form a concentrate, and then blending the concentrate with a lubricating oil basestock to obtain the final formulation, i.e., the fully formulated lubricating oil composition. Such concentrates will typically contain (on an active ingredient (A.I.) basis) from about 10 to about 40 wt. %, and preferably from about 20 to about 35 wt. %, Component A ashless dispersant additive, typically from about 30 to 40 wt. %, preferably from about 15 to 25 wt. Component B antioxidant additive, typically from about 5 to 15 wt. %, and preferably from about 7 to 12 wt. %, Component C antiwear additive, and typically from about 30 to 80 wt. %, preferably from about 40 to 60 wt. %, base oil, based on the concentrate weight.

The fully formulated lubricating oil compositions of this invention are also characterized (1) by a total sulfate ash value (SASH) concentration of from 0.01 to about 0.6 wt. % SASH, preferably from about 0.1 to about 0.5 wt. % SASH, and more preferably from about 0.2 to about 0.45 wt. % SASH; and (2) by a wt. % SASH to wt. % Component A ratio of from about 0.01:1 to about 0.2:1, preferably from about 0.02:1 to 0.15:1, and more preferably from about 0.03:1 to 0.1:1. By "total sulfated ash" herein is meant the total weight % of ash which is determined for a given oil (based on the oil's metallic components) by ASTM D874.

Also in such fully formulated oils the wt. % concentrations of Components A (wt. $\%_A$), B (wt. $\%_B$) and C (wt. $\%_C$) are selected to provide wt. $\%_A$>(wt. $\%_B$+wt. $\%_C$), and preferably to provide wt. $\%_A$>wt. $\%_B$>wt. $\%_C$.

Preferably, in fully formulated oils of this invention wherein Component C comprises at least one metal salt of the aforedescribed dihydrocarbyl dithiophosphoric acid and wherein the oil also contains as an additional component a metal-containing detergent inhibitors (e.g., overbased or neutral alkali and/or alkaline earth metal sulfonates, phenates, salicylates, etc., as will be described below), the proportion by weight of the oil's total sulfated ash value attributable to the metal salt (s) of the dihydrocarbyl dithiophosphoric acid (s) ($SASH_C$) to the proportion by weight of the oil's total sul fated ash value attributable to the metal-containing detergent inhibitor(s) component ($SASH_{DI}$) are such as to provide a $SASH_C$:$SASH_{DI}$ ratio of from about 0.5:1 to 1:1, preferably from about 0.5:1 to 0.9:1, and most preferably from about 0.5:1 to 0.8:1.

The lubricating oil basestock for Components A, B and C typically is adapted to perform a selected function by the incorporation of additional additives therein to form lubricating oil compositions (i.e., formulations).

Natural oils include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as,the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tertbutylphenyl) silicate, hexa-(4-methyl-2-pentoxy) disiloxane, poly(methyl) siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The novel compositions of the present invention can be used with V.I improvers to form multi-grade diesel engine lubricating oils. Viscosity modifiers impart high and low temperature operability to the lubricating oil and permit it to remain relatively viscous at elevated temperatures and also exhibit acceptable viscosity or fluidity at low temperatures. Viscosity modifiers are generally high molecular weight hydrocarbon polymers including polyesters. The viscosity modifiers may also be derivatized to include other properties or functions, such as the addition of dispersancy properties. These oil soluble viscosity modifying polymers will generally have number average molecular weights of from $10^3$ to $10^6$, preferably $10^4$ to $10^6$, e.g., 20 000 to 250,000, as determined by gel permeation chromatography or osmometry.

Examples of suitable hydrocarbon polymers include homopolymers and copolymers of two or more monomers of $C_2$ to $C_{30}$, e.g. $C_2$ to $C_8$ olefins, including both alpha olefins and internal olefins, which may be straight or branched, aliphatic, aromatic, alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylenes, homopolymers and copolymers of $C_6$ and higher alpha olefins, atactic polypropylene, hydrogenated polymers and copolymers and terpolymers of styrene, e.g. with isoprene and/or butadiene and hydrogenated derivatives thereof. The polymer may be degraded in molecular weight, for example by mastication, extrusion, oxidation or thermal degradation, and it may be oxidized and contain oxygen.

The preferred hydrocarbon polymers are ethylene copolymers containing from 15 to 90 wt. % ethylene, preferably 30 to 80 wt. % of ethylene and 10 to 85 wt. %, preferably 20 to 70 wt. % of one or more $C_3$ to $C_{28}$, preferably $C_3$to $C_{18}$, more preferably $C_3$ to $C_8$, alpha-olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octshe, 1-nonene, 1-decene, etc.; also branched chain alpha-olefins, such as 4-methyl-l-pentene, 4-methyl-1-hexene, 5-methylpentene-1,4,4-dimethyl-1-pentene, and 6-methylheptene-1, etc., and mixtures thereof.

Terpolymers, tetrapolymers, etc., of ethylene, said $C_3$–$C_{28}$ alpha-olefin, and a non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and alpha-olefin present.

A class of preferred viscosity modifier polymers are those disclosed in U.S. Pat. Nos. 4,540,753 and 4,804,794, the disclosures of which are hereby incorporated by reference in its entirety.

Also included are nitrogen- or ester-containing polymeric viscosity index improver dispersants which are derivatized polymers such as post-grafted interpolymers of ethylene-propylene with an active monomer such as maleic anhydride which may be further reacted with an alcohol, or amine, e.g. an alkylene polyamine or hydroxy amine, e.g. see U.S. Pat. Nos. 4,089,794; 4,160,739; 4,137,185; or copolymers of ethylene and propylene reacted or grafted with nitrogen compounds such as shown in U.S. Pat. Nos. 4,068,056; 4,068,058; 4,146,489 and 4,149,984.

The polyester V.I. improvers are generally polymers of esters of ethylenically unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl acrylate, stearyl acrylate, eicosanyl acrylate, docosanyl acrylate, decyl methacrylate, diamyl fumarate, lauryl methacrylate, cetyl methacrylate, stearyl methacrylate, and the like and mixtures thereof.

Other esters include the vinyl alcohol esters of $C_2$ to $C_{22}$ fatty or mono carboxylic acids, preferably saturated such as vinyl acetate, vinyl laurate, vinyl palmitate, vinyl stearate, vinyl oleate, and the like and mixtures thereof. Copolymers of vinyl alcohol esters with unsaturated acid esters such as the copolymer of vinyl acetate with dialkyl fumarates, can also be used.

The esters may be copolymerized with still other unsaturated monomers such as olefins, e.g. 0.2 to 5 moles of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, e.g., see U.S. Pat. No. 3,702,300.

Such ester polymers may be grafted with, or the ester copolymerized with, polymerizable unsaturated nitrogen-containing monomers to impart dispersancy to the V.I. improvers. Examples of suitable unsaturated nitrogen-containing monomers include those containing 4 to 20 carbon atoms such as amino substituted olefins as p-(beta-diethylaminoethyl)styrene; basic nitrogen-containing heterocycles carrying a polymerizable ethylenically unsaturated substituent, e.g. the vinyl pyridines and the vinyl alkyl pyridines such as 2-vinyl-5-ethyl pyridine, 2-methyl-5-vinyl pyridine, 2-vinyl-pyridine, 4-vinylpyridine, 3-vinyl-pyridine, 3-methyl-5-vinyl-pyridine, 4-methyl-2-vinyl-pyridine, 4-ethyl-2-vinyl-pyridine and 2-butyl-l-5-vinyl-pyridine and the like.

N-vinyl lactams are also suitable, e.g. N-vinyl pyrrolidones or N-vinyl piperidones.

The vinyl pyrrolidones are preferred and are exemplified by N-vinyl pyrrolidone, N- (1-methylvinyl) pyrrolidone, N-vinyl-5-methyl pyrrolidone, N-vinyl-3, 3,-dimethylpyrrolidone, N-vinyl-5-ethyl pyrrolidone, etc.

Such nitrogen- and ester-containing polymeric viscosity index improver dispersants are generally employed in concentrations of from about 0.05 to 10 wt. % in the fully formulated oil, and preferably from about 0.1 to 5 wt. %, and more preferably from about 0.5 to 3 wt. %, can reduce (e.g., to about 0.5 wt. %) the amount of the above Component (A) ashless dispersant employed to provide the required dispersancy to the oil formulation.

Metal detergent inhibitors are generally basic (viz, overbased) alkali or alkaline earth metal salts (or mixtures thereof, e.g. mixtures of Ca and Mg salts) of one or more organic sulfonic acid (generally a petroleum sulfonic acid or a synthetically prepared alkaryl sulfonic acid), petroleum naphthenic acids, alkyl benzene sulfonic acids, alkyl phenols, alkylene-bis-phenols, oil soluble fatty acids and the like, such as are described in U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,396; 3,342,733; 3,320,162; 3,312,618; 3,318,809; and 3,562,159. For purposes of illustration, the disclosures of the above patents are hereby incorporated in the present specification insofar as the complexes useful in this invention are described. Among the petroleum sulfonates, the most useful products are those prepared by the sulfonation of suitable petroleum fractions with subsequent removal of acid sludge and purification. Synthetic alkaryl sulfonic acids are usually prepared from alkylated benzenes such as the Friedel-Crafts reaction product of benzene and a polymer such as tetrapropylene, $C_{18-C24}$ hydrocarbon polymer, etc. Suitable acids may also be obtained by sulfonation of alkylated derivatives of such compounds as diphenylene oxide thianthrene, phenolthioxine, diphenylene sulfide, phenothiazine, diphenyl oxide, diphenyl sulfide, diphenylamine, cyclohexane, decahydro naphthalene and the like.

Highly basic alkali and alkaline earth metal sulfonates are frequently used as detergents. They are usually produced by heating a mixture comprising an oil-soluble sulfonate or alkaryl sulfonic acid, with an excess of alkali and/or alkaline earth metal compound above that required for complete neutralization of any sulfonic acid present and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms. For example haloparaffins, olefins obtained by dehydrogenation of paraffins, polyolefins produced from ethylene, propylene, etc. are all suitable. The alkaryl sulfonates usually contain from about 9 to about 70 or more carbon atoms, preferably from about 16 to about 50 carbon atoms per alkyl substituted aromatic moiety.

The alkali and alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, and barium, sodium, lithium and potassium. Examples are calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to 220%, although it is preferred to use at least 125%, of the stoichiometric amount of metal required for complete neutralization.

Various other preparations of basic alkaline earth metal alkaryl sulfonates are known, such as U.S. Pat. Nos. 3,150,088 and 3,150,089 wherein overbasing is accomplished by hydrolysis of an alkoxide-carbonate complex with the alkaryl sulfonate in a hydrocarbon solvent-diluent oil.

A preferred Mg sulfonate additive is magnesium alkyl aromatic sulfonate having a total base number ranging from about 250 to about 400 with the magnesium sulfonate content ranging from about 25 to about 32 wt. %, based upon the total weight of this additive system dispersed in mineral lubricating oil. A preferred Ca sulfonate additive is calcium alkyl aromatic sulfonate having a total base number ranging from about 250 to about 500 with the calcium sulfonate content ranging from about 25 to about 32 wt. %, based upon the total weight of this additive system dispersed in mineral lubricating oil.

As an example of a particularly convenient process for the preparation of the complexes used, an oil-soluble sulfonic acid, such as a synthetically prepared didodecylbenzene sulfonic acid, is mixed with an excess of lime (e.g., 10 equivalents per equivalent of the acid) and a promoter such as methanol, heptylphenol, or mixture thereof, and a solvent such as mineral oil, at 50° C.-150° C. and the process mass is then carbonated until a homogeneous mass is obtained. Complexes of sulfonic acids, carboxylic acids, and mixtures thereof are obtainable by processes such as are described in U.S. Pat. No. 3,312,618. Another example is the preparation of a magnesium sulfonate normal magnesium salt thereof, an excess of magnesium oxide, water, and preferably also an alcohol such as methanol.

The carboxylic acids useful for preparing sulfonate carboxylate complexes, and carboxylate complexes, i.e., those obtainable from processes such as the above wherein a mixture of sulfonic acid and carboxylic acid or a carboxylic acid alone is used in lieu of the sulfonic acid, are oil-soluble acids and include primarily fatty acids which have at least about 12 aliphatic carbon atoms and not more than about 24 aliphatic carbon atoms. Examples of these acids include: palmitic, stearic, myristic, oleic, linoleic, dodecanoic, behenic, etc. Cyclic carboxylic acids may also be employed. These include aromatic and cyclo-aliphatic acids. The aromatic acids are those containing a benzenoid structure (i.e., benzene, naphthalene, etc.) and an oil-solubilizing radical or radicals having a total of at least about 15 to 18 carbon atoms, preferably from about 15 to about 200 carbon atoms. Examples of the aromatic acids include: stearyl-benzoic acid, phenyl stearic acid, mono- or poly-wax-substituted benzoic or naphthoic acids wherein the wax group consists of at least about 18 carbon atoms, cetyl hydroxybenzoic acids, etc. The cycloaliphatic acids contemplated have at least about 12, usually up to about 30 carbon atoms. Examples of such acids are petroleum naphthenic acids, cetyl cyclohexane carboxylic acids, di-lauryl decahydronaphthalene carboxylic acids, di-octyl cyclopentane carboxylic acids, etc. The thiocarboxylic acid analogs of the above acids, wherein one or both of the oxygen atoms of the carboxyl group are replaced by sulfur, are also contemplated.

The ratio of the sulfonic acid to the carboxylic acid in mixtures is at least 1:1 (on a chemical equivalent basis) and is usually less than 5:1, preferably from 1:1 to 2:1.

The terms "basic salt" and "overbased salt" are used to designate metal salts wherein the metal is present in stoichiometrically larger amounts than the sulfonic acid radical.

As used in the present specification, the term "complex" refers to basic metal salts which contain metal in an amount in excess of that present in a neutral or normal metal salt. The "base number" of a complex is the number of milligrams of KOH to which one gram of the complex is equivalent as measured by titration. The commonly employed methods for preparing the basic salts involve heating a mineral oil solution of the normal metal salt of the acid with a metal neutralizing agent such as the oxide, hydroxide, carbonate, bicarbonate or sulfide at a temperature above 5° C. and filtering the resulting mass. The use of a "promoter" in the neutralization step to aid the incorporation of a large excess of metal is known and is preferred for the preparation of such compositions. Examples of compounds useful as the promoter include phenolic substances such as phenol, naphthol, alkyl phenols, thiophenol, sulfurized alkyl phenols, and condensation products of formaldehyde with a phenolic substance; alcohols such as methanol, 2-propanol, octanol, cellosolve, carbitol, ethylene glycol, stearyl alcohol and cyclohexanol; and amines such as aniline, phenylene diamine, phenothiazine, phenol beta-naphthylamine and dodecylamine.

Usually, the basic composition obtained according to the above-described method is treated with carbon dioxide until its total base number (TBN) is less than about 50, as determined by ASTM procedure D-2896. In many instances, it is advantageous to form the basic product by adding the Ca or Mg base portionwise and carbonating after the addition of each portion. Products with very high metal ratios (10 or above) can be obtained by this method. As used herein, the term "metal ratio" refers to the ratio of total equivalents of alkaline earth metal in the sulfonate complex to equivalents of sulfonic acid anion therein. For example, a normal sulfonate has a metal ratio of 1.0 and a calcium sulfonate complex containing twice as much calcium as the normal salt has a metal ratio of 2.0. The overbased metal detergent compositions usually have metal ratios of at least about 1.1, for example, from about 1.1 to about 30, with metal ratios of from about 2 to 20 being preferred.

It is frequently advantageous to react the basic sulfonate with anthranilic acid, by heating the two at about 140°-200° C. The amount of anthranilic acid used is generally less than about 1 part (by weight) per 10 parts of sulfonate, preferably 1 part per 40-200 parts of sulfonate. The presence of anthranilic acid improves the oxidation- and corrosion-inhibiting effectiveness of the sulfonate.

Basic alkali and alkaline earth metal sulfonates are known in the art and methods for their preparation are described in a number of patents, such as U.S. Pat. Nos. 3,027,325; 3,312,618; and 3,350,308. Any of the sulfonates described in these and numerous other patents are suitable for use in the present invention.

The metal detergent inhibitor (e.g., the basic Ca and Mg salts) are preferably separately prepared and then admixed in the controlled amounts as provided herein. It will be generally convenient to admix such separately prepared detergent inhibitors in the presence of the diluent or solvent used in their preparation.

Other antioxidants useful in this invention include oil soluble copper compounds. The copper may be blended into the oil as any suitable oil soluble copper compound. By oil soluble we mean the compound is oil soluble under normal blending conditions in the oil or additive package. The copper compound may be in the cuprous or cuptic form. The copper may be in the form of the copper dihydrocarbyl thio- or dithio-phosphates wherein copper may be substituted for zinc in the compounds and reactions described above although one mole of cuprous or cuptic oxide may be reacted with one or two moles of the dithiophosphoric acid, respectively. Alternatively the copper may be added as the copper salt of a synthetic or natural carboxylic acid. Examples include $C_8$ to $C_{18}$ fatty acids such as 2-ethyl hexanoic acid, stearic or palmitic, but unsaturated acids such as oleic or branched carboxylic acids such as naphthenic acids of molecular weight from 200 to 500 or synthetic carboxylic acids are preferred because of the improved handling and solubility properties of the resulting copper carboxylates. Also useful are oil soluble copper dithiocarbamates of the general formula $(RR'NCSS)_nCu$, where n is 1 or 2 and R and R' are the same or different hydrocarbyl radicals containing from 1 to 18 and preferably 2 to 12 carbon atoms and including radicals such as alkyl, alkenyl, aryl, aralkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e., R and R') will generally be about 5 or greater. Copper sulphonates, including alkaryl sulfonates as described herein above, (i.e., salts of optionally sulfurized alkylphenols as described hereinabove) phenates, and acetylacetonates may also be used.

Exemplary of useful copper compounds are copper ($Cu^{I}$ and/or $Cu^{II}$) salts of alkenyl succinic acids or anhydrides. The salts themselves may be basic, neutral or acidic. They may be formed by reacting (a) any of the materials discussed above in the Ashless Dispersant section, which have at least one free carboxylic acid (or anhydride) group with (b) a reactive metal compound. Suitable acid (or anhydride) reactive metal compounds include those such as cuptic or cuprous hydroxides, oxides, acetates, borates, and carbonates or basic copper carbonate.

Examples of the metal salts of this invention are Cu salts of polyisobutenyl succinic anhydride (hereinafter referred to as Cu-PIBSA), and Cu salts of polyisobutenyl succinic acid. Preferably, the selected metal employed is its divalent form, e.g., $Cu^{+2}$. The preferred substrates are polyalkenyl succinic acids in which the alkenyl group has a number average molecular weight ($M_n$) greater than about 700. The alkenyl group desirably has a $M_n$ from about 900 to 1400, and up to 2500, with a $M_n$ of about 950 being most preferred. Especially preferred, of those listed above in the section on Dispersants, is polyisobutylene succinic acid (PIBSA). These materials may desirably be dissolved in a solvent, such as a mineral oil, and heated in the presence of a water solution (or slurry) of the metal bearing material. Heating may take place between 70° and about 200° C. Temperatures of 110° to 140° C. are entirely adequate. It may be necessary, depending upon the salt produced, not to allow the reaction to remain at a temperature above about 140° C. for an extended period of time, e.g., longer than 5 hours, or decomposition of the salt may occur.

The copper antioxidants (e.g., Cu-PIBSA, Cu-oleate, or mixtures thereof) will be generally employed in an amount of from about 50–500 ppm by weight of the metal, in the final lubricating or fuel composition.

The copper antioxidants used in this invention are inexpensive and are effective at low concentrations and therefore do not add substantially to the cost of the product. The results obtained are frequently better than those obtained with previously used antioxidants, which are expensive and used in higher concentrations. In the amounts employed, the copper compounds do not interfere with the performance of other components of the lubricating composition.

While any effective amount of the copper antioxidant can be incorporated into the lubricating oil composition, it is contemplated that such effective amounts be sufficient to provide said lube oil composition with an amount of the copper antioxidant of from about 5 to 500 (more preferably 10 to 200, still more preferably 10 to 180, and most preferably 20 to 130 (e.g., 90 to 120)) part per million of added copper based on the weight of the lubricating oil composition. Of course, the preferred amount may depend amongst other factors on the quality of the basestock lubricating oil.

Corrosion inhibitors, also known as anti-corrosive agents, reduce the degradation of the non-ferrous metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorus for ½ to 15 hours, at a temperature in the range of 65° to 320° C. Neutralization of the phosphosulfurized hydrocarbon may be effected in the manner taught in U.S. Pat. No. 1,969,324.

Other oxidation inhibitors can also be employed in addition to Component B, to assist, where desired, in further reducing the tendency of the mineral oils to deteriorate in service and to thereby reduce the formation of products of oxidation such as sludge and varnish-like deposits on the metal surfaces and to reduce viscosity growth. Such other oxidation inhibitors include alkaline earth metal salts of alkylphenolthioesters having preferably $C_5$ to $C_{12}$ alkyl side chains (such as calcium nonylphenol sulfide, barium t-octylphenyl sulfide, etc.).

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxy-alkylene hydrocarbyl succinimide, S-carboxyalkylene hydrocarbyl succinamic acid and mixtures thereof; U.S. Pat. No. 3,879,306 which discloses N-(hydroxyalkyl) alkenyl-succinamic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are glycerol mono and dioleates, and succinate esters, or metal salts thereof, of hydrocarbyl substituted succinic acids or anhydrides and thiohis alkanols such as described in U.S. Pat. No. 4,344,853.

Pour point depressants lower the temperature at which the fluid will flow or can be poured. Such depressants are well known. Typical of those additives which usefully optimize the low temperature fluidity of the fluid are $C_8$–$C_{18}$ dialkylfumarate vinyl acetate copolymers, polymethacrylates, and wax naphthalene.

Foam control can be provided by an antifoamant of the polysiloxane type, e.g. silicone oil and polydimethyl siloxane.

Organic, oil-soluble compounds useful as rust inhibitors in this invention comprise nonionic surfactants such as polyoxyalkylene polyols and esters thereof, and anionic surfactants such as salts of alkyl sulfonic acids. Such anti-rust compounds are known and can be made by conventional means. Nonionic surfactants, useful as anti-rust additives in the oleaginous compositions of this invention, usually owe their surfactant properties to a number of weak stabilizing groups such as ether linkages. Nonionic anti-rust agents containing ether linkages can be made by alkoxylating organic substrates containing active hydrogens with an excess of the lower alkylene oxides (such as ethylene and propylene oxides)

until the desired number of alkoxy groups have been placed in the molecule.

The preferred rust inhibitors are polyoxyalkylene polyols and derivatives thereof. This class of materials are commercially available from various sources: Pluronic Polyols from Wyandotte Chemicals Corporation; Polyglycol 112-2, a liquid triol derived from ethylene oxide and propylene oxide available from Dow Chemical Co.; and Tergitol, dodecylphenyl or monophenyl polyethylene glycol ethers, and Ucon, polyalkylene glycols and derivatives, both available from Union Carbide Corp. These are but a few of the commercial products suitable as rust inhibitors in the improved composition of the present invention.

In addition to the polyols per se, the esters thereof obtained by reacting the polyols with various carboxylic acids are also suitable. Acids useful in preparing these esters are lauric acid, stearic acid, succinic acid, and alkyl- or alkenyl-substituted succinic acids wherein the alkyl-or alkenyl group contains up to about twenty carbon atoms.

The preferred polyols are prepared as block polymers. Thus, a hydroxy-substituted compound, R—(OH)n (wherein n is 1 to 6, and R is the residue of a mono- or polyhydric alcohol, phenol, naphthol, etc.) is reacted with propylene oxide to form a hydrophobic base. This base is then reacted with ethylene oxide to provide a hydrophylic portion resulting in a molecule having both hydrophobic and hydrophylic portions. The relative sizes of these portions can be adjusted by regulating the ratio of reactants, time of reaction, etc., as is obvious to those skilled in the art. Thus it is within the skill of the art to prepare polyols whose molecules are characterized by hydrophobic and hydrophylic moieties which are present in a ratio rendering rust inhibitors suitable for use in any lubricant composition regardless of differences in the base oils and the presence of other additives.

If more oil-solubility is needed in a given lubricating composition, the hydrophobic portion can be increased and/or the hydrophylic portion decreased. If greater oil-in-water emulsion breaking ability is required, the hydrophylic and/or hydrophobic portions can be adjusted to accomplish this.

Compounds illustrative of $R\text{-}(OH)_n$ include alkylene polyols such as the alkylene glycols, alkylene triols, alkylene tetrols, etc., such as ethylene glycol, propylene glycol, glycerol, pentaerythritol, sorbitol, mannitol, and the like. Aromatic hydroxy compounds such as alkylated mono- and polyhydric phenols and naphthols can also be used, e.g., heptylphenol, dodecylphenol, etc.

Other suitable demulsifiers include the esters disclosed in U.S. Pat. Nos. 3,098,827 and 2,674,619.

The liquid polyols available from Wyandotte Chemical Co. under the name Pluronic Polyols and other similar polyols are particularly well suited as rust inhibitors. These Pluronic Polyols correspond to the formula:

$$HO-(CH_2CH_2O)_x(\underset{\underset{CH_3}{|}}{C}HCH_2O)_y(CH_2CH_2O)_zH \qquad \text{(XXIX)}$$

wherein x, y, and z are integers greater than 1 such that the $-CH_2CH_2O-$ groups comprise from about 10% to about 40% by weight of the total molecular weight of the glycol, the average molecule weight of said glycol being from about 1000 to about 5000. These products are prepared by first condensing propylene oxide with propylene glycol to produce the hydrophobic base $$HO(-\underset{\underset{CH_3}{|}}{C}H-CH_2-O)_y-H \qquad \text{(XXX)}$$

This condensation product is then treated with ethylene oxide to add hydrophylic portions to both ends of the molecule. For best results, the ethylene oxide units should comprise from about 10 to about 40% by weight of the molecule. Those products wherein the molecular weight of the polyol is from about 2500 to 4500 and the ethylene oxide units comprise from about 10% to about 15% by weight of the molecule are particularly suitable. The polyols having a molecular weight of about 4000 with about 10% attributable to $(CH_2CH_2O)$ units are particularly good. Also useful are alkoxylated fatty amines, amides, alcohols and the like, including such alkoxylated fatty acid derivatives treated with $C_9$ to $C_{16}$ alkyl-substituted phenols (such as the mono- and di-heptyl, octyl, nonyl, decyl, undecyl, dodecyl and tridecyl phenols) , as described in U.S. Pat. No. 3,849,501, which is also hereby incorporated by reference in its entirety.

These compositions of our invention may also contain other additives such as those previously described, and other metal containing additives, for example, those containing barium and sodium.

The lubricating composition of the present invention may also include copper lead bearing corrosion inhibitors. Typically such compounds are the thiadiazole polysulphides containing from 5 to 50 carbon atoms, their derivatives and polymers thereof. Preferred materials are the derivatives of 1,3,4-thiadiazoles such as those described in U.S. Pat. Nos. 2,719,125; 2,719,126; and 3,087,932; especially preferred is the compound 2,5-bis (t-octadithio)-1,3,4 thiadiazole commercially available as Amoco 150, or 2,5-bis(nonyldithio)-1,3,4-thiadiazole available as Amoco 158. Other similar materials also suitable are described in U.S. Pat. Nos. 3,821,236; 3,904,537; 4,097,387; 4,107,059; 4,136,043; 4,188,299; and 4,193,882. Derivatives of thiadiazole mercaptans may be used such as esters, condensation products with halogenated carboxylic acids, reaction products with aldehydes and amines, alcohols or mercaptans, amine salts, dithiocarbamates, reaction products with ashless dispersants (e.g. , U.S. Pat. No. 4,140,643 and U.S. Pat. No. 4,136,043) and reaction products with sulfur halides and olefins.

Other suitable additives are the thio and polythio sulphenamides of thiadiazoles such as those described in U.K. Patent Specification 1,560,830. When these compounds are included in the lubricating composition, we prefer that they be present in an amount from 0.01 to 10, preferably 0.1 to 5.0 weight percent based on the weight of the composition.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts effective to provide their normal attendant function. Representative effective amounts of such additives (as the respective active ingredients) in the fully formulated oil are illustrated as follows:

| Compositions | Wt. % A.I. (Preferred) | Wt. % A.I. (Broad) |
|---|---|---|
| Component A | 4–7 | 2–10 |
| Component B | 0.5–4 | 0.2–6 |
| Component C | 1.0–2 | 0.8–3 |
| Viscosity Modifiers | 0–4 | 0–12 |
| Detergents | 0.01–0.4 | 0.01–0.6 |
| Corrosion Inhibitors | 0.01–0.5 | 0–1.5 |
| Other Oxidation Inhibitors | 0–1.5 | 0–5 |
| Pour Point Depressants | 0.01–0.5 | .01–1.0 |
| Anti-Foaming Agents | 0.001–0.01 | .001–0.1 |
| Other Anti-Wear Agents | 0.001–1.5 | 0–5 |
| Friction Modifiers | 0.01–1.5 | 0–5 |
| Lubricating Base Oil | Balance | Balance |

Preferably, when the Component (B) comprises a sulfurized alkyl-substituted hydroxy aromatic compound (e.g., sulfurized alkyl-substituted phenol) the sulfurized alkyl-substituted hydroxy aromatic compound is employed in the fully formulated oil in an amount of from about 2 to 6 wt. %, and preferably from about 2.2 to 4 wt. %. Lower amounts of the sulfurized alkyl-substituted hydroxy aromatic compound can be employed (e.g., employed in amount of from about 0.5 to 3 wt. %). When a mixture of such compounds and other oil soluble antioxidant materials (as discussed above) are employed as Component (B) herein (e.g., mixtures with oil soluble sulfurized organic compounds, oil soluble amine antioxidants, oil soluble organo borates, oil soluble organo phosphites, oil soluble organo phosphates, oil soluble organo dithiophosphates and mixtures thereof).

When other additives are employed, it may be desirable, although not necessary, to prepare additive concentrates comprising concentrated solutions or dispersions of the novel detergent inhibitor/antiwear agent mixtures of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the additives in proper amounts to provide the desired concentration in the formulation when the additive-package is combined with a predetermined amount of base lubricant. Thus, the ashless dispersant/antioxidant antiwear agent mixtures of the present invention can be added to small amounts of base oil or other compatible solvents along with other desirable additives to form additive-packages containing active ingredients in collective amounts of typically from about 2.5 to about 90%, and preferably from about 15 to about 75%, and most preferably from about 25 to about 60% by weight additives in the appropriate proportions with the remainder being base oil.

The final formulations may employ typically about 10 wt. % of the additive-package with the remainder being base oil.

All of said weight percents expressed herein (unless otherwise indicated) are based on active ingredient (A.I.) content of the additive, and/or upon the total weight of any additive-package, or formulation which will be the sum of the A.I. weight of each additive plus the weight of total oil or diluent.

This invention will be further understood by reference to the following examples, wherein all parts are parts by weight, unless otherwise noted and which include preferred embodiments of the invention.

EXAMPLES

A series of fully formulated SAE 15W40 lubricating oils are prepared having the components identified in Table I.

TABLE I

| TEST FORMULATIONS (VOL %) | Comparative A | Comparative B | Example 1 | Example 2 |
|---|---|---|---|---|
| PIBSA-PAM Dispersant(1) | 7.57 | 5.54 | 7.57 | 7.57 |
| Sulfurized Alkyl Phenol Antioxidant(2) | 2.83 | 1.8 | 2.83 | 2.83 |
| Zinc Dialkyl Dithiophosphate Antiwear Agent(3) | 1.75 | 1.45 | 1.35 | 1.35 |
| Overbased Mg Sulfonate Detergent Inhibitor(4) | 1.19 | 1.45 | 0.51 | 0.51 |
| Viscosity Index Improver(5) | 8.82 | — | 8.20 | 8.40 |
| Base Oil(6) | Balance | Balance | Balance | Balance |
| TBN(7) | 8.4 | 8.0 | 5.0 | 5.0 |
| SASH(8) | 0.85 | 0.84 | 0.44 | 0.5 |

NOTES:

(1)Mixture of 5.93 vol % of polyisobutenyl succinimide (1.58 wt % N, 950 $\overline{M}_n$ PIB, 1.0 SA:PIB mole ratio, 0.35 wt %, B, 51.5 wt % ai); and 1.64 vol % of polyisobutenyl succinimide, 1.46 wt % N, 1300 $\overline{M}_n$ PIB, 1.2 SA:PIB mole ratio, 0.32 wt % B, 50.8 wt % ai). As used herein, SA:PIB mole ratio refers to the moles of succinic anhydride reacted per mole of polyisobutylene to form polyisobutenyl succinic anhydride used to fo rm the described succinimides.

(2)Sulfurized Nonylphenol (70 wt % ai, 7 wt % S).

(3)Comparative Ex. A.: 1.45 vol % zinc dihydrocarbyl dithiophosphate (ZDDP) antiwear additive in which the alkyl groups contained 8 carbon atoms and was made by reacting $R_2S_5$ with iso-octyl alcohol to give a phosphorous level of about 7 wt %; 0.30 vol % ZDDP antiwear additive in which the allkyl groups were a mixture of such groups having between about 4 and 5 carbon atoms and made by reacting $P_2S_5$ with a mixture of about 65% isobutyl alcohol and 35% of amyl alcohol, to give a phosphorous level of about 8 wt %. Comparative Ex. B, and Example 1: 1.45 vol. % in which the alkyl groups contained 8 carbon atoms and was made by reacting $R_2S_5$ with iso-octyl alcohol to give a phosphorous level of about 7 wt % ZDDP antiwear additive.

(4)Overbased Mg sulfonate (based on an alkyl benzene sulfonic acid), 400 TBN, 51.7 wt % ai; 9.2 wt % Mg.

(5)Compar. Ex A and Ex 1 = ethylene-propylene copolymer viscosity index improver concentrate (43 wt % ethylene; 2.8 thickening efficiency; 10.0 wt % ai); Ex 2 = dispersant viscosity index improver concentrate (nitrogen-containing ethylene-propylene copolymer 0.3 wt % N; 1.5 thickening efficiency; 23 wt % ai).

(6)Principally Solvent 150 Neutral base oil.

(7)Total base number: ASTM D2896.

(8)Total sulfated ash level (ASTM D874).

The formulations are subjected to a Cummins NTC-400 field test (loads=refrigerated trailers; 80,000 lbs. gross vehicle weight, approx. 80% load factor; continental United States service (ex-Alaska), with majority of hauling from Dallas to Pacific Northwest, wherein diesel fuels <0.3 wt % sulfur were employed.

Also included in the above tests are the following commercial SAE 15W40 lubricating oils. These formulations include ashless dispersant, overbased alkaline earth metal detergent inhibitors, and zinc dihydrocarbyl dithiophosphate antiwear agents.

| Comparative Test Oils | Wt % SASH | TBN (D2896) |
|---|---|---|
| Oil C | 1.0 | 10 |
| Oil D | 1.1 | 12 |
| Oil E | 0.72 | 6.9 |
| Oil F | 1.0 | 10 |
| Oil G | 1.0 | 8 |

-continued

| Comparative Test Oils | Wt % SASH | TBN (D2896) |
|---|---|---|
| Oil H | 1.0 | 8 |
| Oil I | 1.0 | 8 |
| Oil J | 0.9 | 7 |
| Oil K | 1.95 | 14 |

The data thereby obtained are set forth in Table III.

TABLE IV-continued

| Engine Tests* | Example 3 Test Results | API "CE" Limit | Pass/ Fail |
|---|---|---|---|
| Total Demerits | 649 | 650 max | |
| Max Proudness, in. | 0.009 | 0.020 max | |
| Ring Wt. Loss, mg. | 307 | 350 max | |
| Viscosity Increase, cSt | 4.2 | 14 max | |
| Estimated Mack Merits | 112 | 90 min | |
| Mack T-7 | 0.0092 | 0.040 max | Pass |
| 100–150 Hour Viscosity Increase Rate, cSt/hr | | | |

TABLE III

| OIL TYPE | COMPARATIVE EXAMPLES A | B | C | D | E | F | G | H | I | J | K | COMMERCIAL OIL AVG SIGMA (G) | | EXAMPLE 1 |
|---|---|---|---|---|---|---|---|---|---|---|---|---|---|---|
| UNIT MILEAGE | 196K | 207K | 175K | 195K | 211K | 189K* | 187K | 173K | 200K | 183K | 177K | 190K | 12.8 | 168K |
| AVG. SLUDGE | 9.84 | 9.78 | 9.76 | 9.83 | 9.75 | 9.81 | 9.76 | 9.75 | 9.74 | 9.73 | 9.78 | 9.78 | 0.04 | 9.76 |
| TGF, % | 67 | 40 | 40 | 70 | 56 | — | 63 | 64 | 84 | 59 | 83 | 63 | 15 | 35 |
| 2ND GF, % | 39 | 39 | 34 | 40 | 85 | — | 73 | 40 | 47 | 76 | 30 | 50 | 19.8 | 66 |
| 3RD GF, | 8 | 5 | 0 | 1 | 15 | — | 6 | 5 | 6 | 10 | 3 | 5.9 | 4.4 | 2 |
| 4G DEMERIT | 0.59 | 1.29 | 0.32 | 0.67 | 1.86 | — | 0.63 | 0.71 | 0.21 | 2.21 | 0.7 | 0.92 | 0.66 | 1.8 |
| CROWNLAND | | | | | | | | | | | | | | |
| HEAVY CARBON, % | 8 | 9 | 24 | 10 | 7 | 15 | 7 | 22 | 43 | 15 | 62 | 20.2 | 17.6 | 10 |
| POLISHED CARBON % | 17 | 35 | 59 | 35 | 29 | 45 | 39 | 33 | 49 | 32 | 35 | 37.1 | 11.0 | 31 |
| CLEAN, % | 1 | 0 | 0 | 0 | 1 | 0 | 3 | 8 | 0 | 0 | 5 | 1.6 | 2.6 | 12 |
| TOTAL LAND DEMERITS | 21.59 | 26.42 | 28.8 | 22.73 | 36.37 | — | 31.47 | 28.11 | 27.55 | 35.14 | 20.4 | 27.86 | 5.4 | 28.4 |
| UNDERCROWN DEMERITS | 5.13 | 5.44 | 1.88 | 3.51 | 10.00 | — | 3.19 | 4.19 | 3.69 | 4.88 | 2.0 | 4.39 | 2.31 | 7.8 |
| TTL. UNWEIGHTED DEM | 137 | 115 | 119 | 138 | 199 | — | 180 | 140 | 167 | 185 | 137 | 151.7 | 29.0 | 138 |
| TOTAL WEIGHTED DEM | 987 | 1073 | 872 | 889 | 2144 | — | 1574 | 1022 | 1069 | 1840 | 703 | 1217 | 471 | 1355 |
| OIL ECONOMY, ML/QT. | 524 | 473 | 609 | 1024 | 450 | 513 | 612 | 694 | 312 | 332 | 613 | 536 | 203 | 359 |
| CYLINDER LINER | | | | | | | | | | | | | | |
| MAX, WEAR, IN. | .0015 | .0018 | .0028 | .0018 | .0023 | .0025 | .0008 | .0022 | .0017 | .0015 | .0015 | .00185 | .0006 | .0017 |
| AVG. MAX. WEAR, IN. | .0012 | .0012 | .0022 | .0012 | .0021 | .0023 | .0007 | .0015 | .0013 | .0013 | .0013 | .0015 | .0005 | .0017 |
| WEAR RATE, IN./100 KMI | .0006 | .0006 | .0013 | .0006 | .0010 | .0012 | .0004 | .0009 | .0007 | .0007 | .0007 | .0008 | .0003 | .0010 |
| HONE RETAINED, % | 83 | 93 | 95 | 95 | 92 | 92 | 88 | 94 | 92 | 93 | 80 | 90.6 | 4.9 | 80 |
| BORE POLISH, % | 7 | 7 | 2 | 2 | 8 | 7 | 9 | 7 | 9 | 7 | 9 | 6.7 | 2.5 | 9 |
| RING GAPS, IN. | | | | | | | | | | | | | | |
| NO. 1 | .025 | .026 | .024 | .028 | .027 | .027 | .030 | .027 | .025 | .025 | .022 | .026 | .002 | .022 |
| NO. 2 | .031 | .030 | .028 | .030 | .028 | .031 | .031 | .028 | .030 | .030 | .024 | .029 | .002 | .023 |
| NO. 3 | .024 | .027 | .023 | .029 | .026 | .025 | .028 | .028 | .027 | .025 | .024 | .026 | .002 | .028 |
| NO. 4 | .024 | .020 | .019 | .020 | .019 | .025 | .025 | .020 | .019 | .021 | .014 | .021 | .003 | .014 |
| CON ROD BEARING, % C4 | | | | | | | | | | | | | | |
| ROD | 0 | 0 | 0 | 0 | 0 | 0 | 0 | 0 | 0 | 0 | 0 | 0 | — | 0 |
| CAP | 0 | 0 | 0 | 0 | 0 | 0 | 0 | 0 | 0 | 0 | 0 | 0 | — | 0 |

PISTON DEPOSIT RATINGS UNAVAILABLE - SITE MAINTENANCE PERSONNEL CLEANED AND RE-USED PISTONS.

From the data in Table III, it can be seen that the oil of Example 1 provides superior crownland cleanliness without sacrificing any of the remaining performance properties.

EXAMPLE 3

The low ash lubricating oil of Example 1 was subjected to a series of additional engine tests, and the data thereby obtained are summarized in Table IV. As can be seen, the oil of Example I passes all of the requirements of the American Petroleum Institute's CE specification for commercial heavy duty diesel lubricating oils.

TABLE IV

| Engine Tests* | Example 3 Test Results | API "CE" Limit | Pass/ Fail |
|---|---|---|---|
| L-38 Total Bearing Wt. Loss, mg. | 33.8 | 50 max | Pass |
| Caterpillar 1G/2 (480 hrs.) | | | |
| TGF | 54 | 80 max | Pass |
| WTD | 204 | 300 max | |
| Mack T-6 | | | |
| Oil Consumption, lb/Hp-hr | 0.00049 | 0.0014 max | Pass |
| Cummins NTC-400 | | | |
| Oil Consumption | SEE FIG. 1 | | Pass |
| Crownland Carbon, % | 9.2 | 25 max | |
| Third Land Demertis | 12.1 | 40 max | |
| Roller Follower Pin Wear, in. | 0.0000 | 0.002 max | |

*Performance procedure described in Society of Automotive Engineers Specification J183.

The low ash oils of this invention are preferably employed in heavy duty diesel engines which employ normally liquid fuels having a sulfur content of less than 1 wt. %, more preferably less than 0.5 wt. %, still more preferably less than 0.3 wt. % (e.g., from about 0.1 to about 0.3 wt %), and most preferably less than 0.1 wt. % (e.g., from 100 to 500 ppm sulfur). Such normally liquid fuels include hydrocarbonaceous petroleum distillate fuels such as diesel fuels or fuel oils as defined by ASTM Specification D396. Compression ignited engines can also employ normally liquid fuel compositions comprising non-hydrocarbonaceous materials such as alcohols, ethers, organonitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbenaceous materials are also contemplated. Examples of such mixtures are combinations of diesel fuel and ether. Particularly preferred is No. 2 diesel fuel. These oils can also be employed in natural gas fueled engines, which are normally supplied with fuel from a storage reservoir containing compressed, liquified natural gas. Methanol and natural gas engines are particularly useful, in combination with the oils of this invention, in minimizing low particulate emissions from engine exhausts in vehicles such as diesel trucks, buses and the like.

The lubricating oils of this invention are particularly useful in the crankcase of diesel engines having at least one cylinder (generally from 1 to 8 or more cylinders per engine) wherein there is housed for vertical cyclic reciprocation therein a piston provided with a tight top land, that is, cylinders wherein the distance between the piston's top land and the cylinder wall liner is reduced to minimize the amount of particulates generated in the cylinder's firing chamber (wherein the fuel is combusted to generate power). Such tight top lands can also provide improved fuel economy and an increase in the effective compression ratio in the cylinder. The top land comprises the region of the generally cylindrical piston above the top piston ring groove, and the top land, therefore, is generally characterized by a circular cross-section (taken along the longitudinal axis of the piston). The outer periphery of the top land can comprise a substantially vertical surface which is designed to be substantially parallel to the vertical walls of the cylinder liner. (Such top lands are herein referred to as "cylindrical top lands".) Or, as is preferred, the top land can be tapered inwardly toward the center of the piston from the point at which the top land adjoins the top piston ring groove and the uppermost surface of the piston, i.e., the "crown". The distance between the top land and the cylinder wall liner, herein called the "top land clearance", will preferably range from about 0.010 to 0.030 inch for cylindrical top lands. For tapered top lands, the lower top land clearance (that is, the top land clearance at the point at which the top land is adjoined to the top piston ring groove) is preferably from about 0,005 to 0,030 inch, and more preferably from about 0,010 to 0,020 inch, and the upper top land clearance, that is, the top land clearance at the piston crown, is preferably from about 0.010 to 0.045 inch, and more preferably from about 0.015 to 0.030 inch. While the top land clearance can be less than the dimensions given above (e.g., less than 0.005 inch), if such lesser distances do not result in undesired contact of the top land portion of the piston with the cylinder wall liner during operation of the engine, which is undesirable due to the resultant damage to the liner. Generally, the height of the top land (that is, the vertical distance, as measured along the cylinder wall liner, from the bottom of the top land to the top of the top land) is from about 0.1 to about 1.2 inch, which is generally from about 0.8 to 1.2 inch for 4-cycle diesel engines and from about 0.1 to 0.5 inch for 2-cycle diesel engines. The design of diesel engines and such pistons having such tight top lands is within the skill of the skilled artisan and need not be further described herein.

As used herein, the term "oil soluble" is intended to mean that the additive or material identified is soluble, dissolvable in oil with the aid of a suitable solvent, or stably dispersible. For clarity, the term "oil soluble" does not necessarily indicate that the additive or material is soluble (or dissolvable, miscible or capable of being suspended) in oil in all proportions. It does mean, however, that the additives, for instance, are soluble (or stably dispersible) in oil to an extent sufficient to exert their intended effect in the environment in which the oil is employed. Moreover, the additional incorporation of other additives may also permit incorporation of higher levels of a particular polymer adduct hereof, if desired.

The principles, preferred embodiments, and modes of operation of the present invention have been described in the foregoing specification. The invention which is intended to be protected herein, however, is not to be construed as limited to the particular forms disclosed, since these are to be regarding as illustrative rather than restrictive. Variations and changes may be made by those skilled in the art without departing from the spirit of the invention.

What is claimed is:

1. A low sulfated ash heavy duty diesel crankcase lubricating oil composition which comprises a major amount of an oil of lubricating viscosity and (A) at least about 2 weight percent of at least one oil soluble ashless dispersant selected from the group consisting of (i) oil soluble salts, amides, imides, oxazolines and esters, and mixtures thereof, of long chain hydrocarbon substituted mono and dicarboxylic acids or their anhydrides or esters; (ii) long chain aliphatic hydrocarbon having a polyamine attached directly thereto; (iii) Mannich condensation products formed by condensing about a molar proportion of long chain hydrocarbon substituted phenol with about 1 to 2.5 moles of formaldehyde and about 0.5 to 2 moles of polyalkylene polyamine; and (iv) Mannich condensation products formed by reacting long chain hydrocarbon substituted mono- and dicarboxylic acids or anhydrides or esters with an aminophenol or a hydrocarbon substituted aminophenol, to form a long chain hydrocarbon substituted amide or imide-containing phenol intermediate adduct, and condensing about a molar proportion of the long chain hydrocarbon substituted amide- or imide-containing phenol intermediate adduct with about 1 to 2.5 moles of formaldehyde and bout 0.5 to 2 moles of polyamine wherein said long chain hydrocarbon group in (i), (ii) (iii) and (iv) is a polymer of a $C_2$ to $C_{10}$ monoolefin, said polymer having a number average molecular weight of about 1,000 to about 5,000;

(B) an antioxidant effective amount of at least one oil soluble antioxidant material; and (C) at least one oil soluble dihydrocarbyl dithiophosphate material, wherein each hydrocarbyl group has, on average, at least 3 carbon atoms; wherein the lubricating oil comprises a total sulfated ash (SASH) level of less than 0.6 weight percent and a SASH weight:ashless dispersant weight ratio of from about 0.01:1 to about 0.2:1.

2. The composition of claim 1 wherein said oil soluble antioxidant material comprises at least one member selected from the group consisting of oil soluble phenolic compounds, oil soluble sulfurized organic compounds, oil soluble amine antioxidants, oil soluble organo borates, oil soluble organo phosphites, oil soluble organo phosphates, oil soluble organo dithiophosphates and mixtures thereof.

3. The composition of claim 2 wherein said oil soluble antioxidant material is substantially metal-free.

4. The composition of claim 2 wherein said oil soluble antioxidant material is substantially ashless and comprises a sulfated ash value of not greater than 1 wt. %.

5. The composition of claim 1 wherein said oil soluble antioxidant material comprises at least one sulfurized alkyl-substituted hydroxy aromatic compound containing at least one hydroxy group and at least one $C_6$ to $C_{20}$ alkyl group attached to the same aromatic ring which is reacted with a sulfurizing agent at a temperature of from about 100° to 250° C.

6. The composition of claim 5 which comprises said sulfurized alkyl-substituted hydroxy aromatic compound in an amount of at least about 2 wt. %.

7. The composition of claim 1 wherein said dihydrocarbyl dithiophosphate material comprises a metal salt wherein said metal comprises at least one metal selected from the group consisting of Group I metals, Group II metals, Al, Sn, Pb, Mo, Mn, Co and Ni.

8. The composition of claim 7 wherein each hydrocarbyl group in said dihydrocarbyl dithiophophate material comprises alkyl of from 3 to 18 carbon atoms.

9. The composition of claim 8 wherein said metal comprises Zn.

10. The composition of claim 9 wherein said ashless dispersant comprises polyisobutenyl succinimide of a polyalkylene polyamine having an average of from 2 to 60 carbon atoms and from 1 to 12 nitrogen atoms per molecule of said polyamine wherein said polyisobutylene moiety is derived from polyisobutylene having a number average molecular weight of from about 1,150 to 3,000.

11. The composition of claim 10 wherein said SASH wt:ashless dispersant wt ratio is from about 0.03:1 to 0.1:1.

12. The composition of claim 1 wherein said ashless dispersant comprises the product of (a) a hydrocarbyl substituted $C_4$ to $C_{10}$ monounsaturated dicarboxylic acid producing material formed by reacting an olefin polymer of $C_2$ to $C_{10}$ monoolefin having a number average molecular weight of about 1,500 to 3,000 and a $C_4$ to $C_{10}$ monounsaturated acid material, said acid producing material having an average of at least 0.8 dicarboxylic acid producing moieties, per molecule of said olefin polymer present in the reaction mixture used to form said acid producing material, and (b) a nucleophilic reactant selected from the group consisting of amines, alcohols, amino-alcohols and mixtures thereof.

13. The composition of claim 12 wherein said nucleophilic reactant comprises an amine.

14. The composition of claim 13 wherein said amine contains from 2 to 60 carbon atoms and from 1 to 12 nitrogen atoms per molecule.

15. The composition of claim 14 wherein said amine comprises a polyalkylenepolyamine wherein each alkylene group in said polyalkylenepolyamine contains 2 to 6 carbons and said polyalkylenepolyamine contains from 2 to about 9 nitrogen atoms per molecule.

16. The composition of claim 15 wherein said amine comprises polyethylenepolyamine.

17. The composition of claim 12 wherein said hydrocarbyl substituted acid producing material contains from about 0.8 to about 2 moles of succinic moieties per mole of said olefin polymer employed in said reaction mixture.

18. The composition of claim 17 wherein each ashless dispersant contains about 0.05 to 2.0 weight percent boron.

19. The composition of any of claims 12 to 18 wherein said olefin polymer comprises polyisobutylene.

20. The composition of claim 19 wherein said number average molecular weight of said olefin polymer is from about 1,800 to 3,000, and wherein said amine comprises a polyethylene polyamine.

21. The composition of claim 20 wherein said SASH level is from about 0.2 to about 0.45 weight percent.

22. The composition of claim 21 wherein said SASH-:ashless dispersant ratio is from about 0.02:1 to 0.15:1.

23. The composition of claim 22 wherein said composition additionally comprises a high molecular weight hydrocarbon polymer viscosity index improver.

24. A lubrication oil additive package concentrate which comprises:

(A) from about 10 to 40 weight percent of at least one oil soluble ashless disputant selected from the group consisting of (i) oil soluble salts, amides, imides, oxazolines and esters, and mixtures thereof, of long chain hydrocarbon substituted mono and dicarboxylic acids or their anhydrides or esters; (ii) long chain aliphatic hydrocarbon having a polyamine attached directly thereto; (iii) Mannich condensation products formed by condensing about a molar proportion of long chain hydrocarbon substituted phenol with about 1 to 2.5 moles of formaldehyde and about 0.5 to 2 moles of polyalkylene polyamine; and (iv) Mannich condensation products formed by reacting long chain hydrocarbon substituted mono- and dicarboxylic acids or their anhydrides or esters with an aminophenol or a hydrocarbon substituted aminophenol, to form a long chain hydrocarbon substituted amide or imide-containing phenol intermediate adduct, and condensing about a molar proportion of the long chain hydrocarbon substituted amide- or imide-containing phenol intermediate adduct with about 1 to 2.5 moles of formaldehyde and about 0.5 to 2 moles of polyamine wherein said long chain hydrocarbon group in (i), (ii) and (iii) is a polymer of a $C_2$ to $C_{10}$ monoolefin, said polymer having a number average molecular weight of about 1,000 to about 5,000;

(B) from about 3 to 40 weight percent of at least one oil soluble antioxidant material; and (C) from about 5 to 15 weight percent of at least one oil soluble dihydrocarbyl dithiphosphate material, wherein each hydrocarbyl group has, on average, at least 3 carbon atoms; and (D) from about 30 to 80 weight percent base oils wherein the total sulfated ash value in said additive package concentrate (SASH) and the concentration of said ashless dispersant in said concentrate is from about 0.01 to 0.2 parts by weight of SASH per part by weight of said ashless dispersant.

25. A low sulfated ash heavy duty diesel crankcase lubricating oil composition prepared by admixing a major amount of an oil of lubricating viscosity with (A) at least about 2 weight percent of at least one oil soluble ashless dispersant selected from the group consisting of (i) oil soluble salts, amides, imides, oxazolines and esters, and mixtures thereof, of long chain hydrocarbon substituted mono and dicarboxylic acids or their anhydrides or esters;

(ii) long chain aliphatic hydrocarbon having a polyamine attached directly thereto;

(iii) Mannich condensation products formed by condensing about a molar proportion of long chain hydrocarbon substituted phenol with about 1 to 2.5 moles of formaldehyde and about 0.5 to 2 moles of polyalkylene polyamine; and (iv) Mannich condensation products formed by reacting long chain hydrocarbon substituted mono- and dicarboxylic acids or anhydrides or esters with an aminophenol or a hydrocarbon substituted aminophenol, to form a long chain hydrocarbon substituted amide or imide-containing phenol intermediate adduct, and condensing about a molar proportion of the long chain hydrocarbon substituted amide- or imide-containing phenol intermediate adduct with about 1 to 2.5 moles of formaldehyde and about 0.5 to 2 moles of polyamine wherein said long chain hydrocarbon group in (i), (ii), (iii) and (iv) is a polymer of a $C_2$ to $C_{10}$ monoolefin, said polymer having a number average molecular weight of about 1,000 to about 5,000;

(B) an antioxidant effective amount of at least one oil soluble antioxidant material; and (C) at least one oil soluble dihydrocarbyl dithiophosphate material, wherein each hydrocarbyl group has, on average, at least 3 carbon atoms;

wherein the lubricating oil composition comprises a total sulfate ash (SASH) level of less than 0.6 weight percent and the weight ratio of SASH weight to the weight of ashless dispersant admixed is from about 0.01:1 to about 0.2:1.

26. The composition of claim 25 wherein the ashless dispersant comprises polyisobutenyl succinimide of a polyalkylene polyamine having an average of from 2 to 60 carbon atoms and from 1 to 12 nitrogen atoms per molecule of said polyamine, wherein said polyisobutylene moiety is derived from polyisobutylene having a number average molecular weight of from about 1,150 to 3,000.

27. The composition of claim 25 wherein the dihydrocarbyl dithiophosphate material comprises a metal salt wherein the metal comprises at least one metal selected from the group of Group I metals, group II metals, Al, Sn, Pb, Mo, Mn, Co and Ni.

28. The composition of claim 27 wherein the metal comprises zinc and the hydrocarbyl groups in the dihydrocarbyl dithiophosphate material each comprises an alkyl group having from 4 to 18 carbon atoms.

29. The composition of any one of claims 25, 26, 27 or 28 wherein the oil soluble antioxidant material comprises at least one member selected from the group consisting of oil soluble phenolic compounds, oil soluble sulfurized organic compounds, oil soluble amine antioxidants, oil soluble organo borates, oil soluble organo phosphates, oil soluble organo dithiophosphates and mixtures thereof.

30. The composition of claim 29 wherein the oil soluble antioxidant material is an alkylated monophenol.

31. The composition of any one of claims 25, 26, or 27 wherein the soluble antioxidant material is a sulfurized composition selected from the group consisting of aromatic, alkyl and alkenyl sulfides and polysulfides; sulfurized carboxylic acid esters; sulfurized olefins; sulfurized oil; and mixtures thereof.

32. A lubricating oil additive package concentrate prepared by admixing (A) from about 10 to 40 weight percent of at least one oil soluble ashless dispersant selected from the group consisting of (i) oil soluble salts, amides, imides, oxazolines and esters, and mixtures thereof, of long chain hydrocarbon substituted mono and dicarboxylic acids or their anhydrides or esters;

(ii) long chain aliphatic hydrocarbon having a polyamine attached directly thereto;

(iii) Mannich condensation products formed by condensing about a molar proportion of long chain hydrocarbon substituted phenol with about 1 to 2.5 moles of formaldehyde and about 0.2 to 2 moles of polyalkylene polyamine; and (iv) Mannich condensation products formed by reacting long chain hydrocarbon substituted mono- and dicarboxylic acids or their anhydrides or esters with an aminophenol or a hydrocarbon substituted aminophenol, to form a long chain hydrocarbon substituted amide or imide-containing phenol intermediate adduct, and condensing about a molar proportion of the long chain hydrocarbon substituted amide- or imide-containing phenol intermediate adduct with about 1 to 2.5 moles of formaldehyde and about 0.5 to 2 moles of polyamine wherein said long chain hydrocarbon group in (i), (ii) (iii) and (iv) is a polymer of a $C_2$ to $C_{10}$ monoolefin, said polymer having a number average molecular weight of about 1,000 to about 5,000;

(B) from about 3 to 40 weight percent of at least one oil soluble antioxidant material;

(C) from about 5 to 15 weight percent of at least one oil soluble dihydrocarbyl dithiophosphate material, wherein each hydrocarbyl group has, on average, at least 3 carbon atoms; and (D) from about 30 to 80 weight percent base oils wherein the total sulfated ash value in said additive package concentrate (SASH) and the concentration of ashless dispersant admixed to prepare said concentrate is from about 0.01 to 0.2 parts by weight of SASH per part by weight of said ashless dispersant.

33. The composition of claim 32 wherein the ashless dispersant comprises polyisobutenyl succinimide of a polyalkylene polyamine having an average of from 2 to 60 carbon atoms and from 1 to 12 nitrogen atoms per molecule of said polyamine, wherein said polyisobutylene moiety is derived from polyisobutylene having a number average molecular weight of from about 1,150 to 3,000.

34. The composition of claim 32 wherein the dihydrocarbyl dithiophosphate material comprises a metal salt wherein the metal comprises at least one metal selected from the group of Group I metals, Groups II metals, Al, Sn, Pb, Mo, Mn, Co and Ni.

35. The composition of claim 34 wherein metal comprises zinc and the hydrocarbyl groups in the dihydrocarbyl dithiophosphate material each comprises an alkyl group having from 4 to 18 carbon atoms.

36. The composition of any one of claims 32, 33, 34 or 35 wherein the oil soluble antioxidant material comprises at least one member selected from the group consisting of oil soluble phenolic compounds, oil soluble sulfurized organic compounds, oil soluble amine antioxidants, oil soluble organo borates, oil soluble organo phosphates, oil soluble organo dithiophosphates and mixtures thereof.

37. The composition of claim 36 wherein the oil soluble antioxidant material is an alkylated monophenol.

38. The composition of any one of claim 32, 33, or 36 wherein the soluble antioxidant material is a sulfurized composition selected from the group consisting of aromatic, alkyl and alkenyl sulfides and polysulfides; sulfurized carboxylic acid esters; sulfurized olefins; sulfurized oil; and mixtures thereof.

39. The composition of claims 2, 24, 25 or 32 wherein the oil soluble antioxidant material comprises an oil soluble sulfurized alkyl-substituted hydroxyaromatic compound.

40. The composition of claims 2, 24, 25 or 32 wherein the oil soluble antioxidant material comprises an oil soluble sulfurized olefin.

41. The composition of claims 2, 24, 25 or 32 wherein the oil soluble antioxidant material comprises an oil soluble sulfurized carboxylic acid ester.

* * * * *